US010480365B2

(12) United States Patent
Goodier et al.

(10) Patent No.: US 10,480,365 B2
(45) Date of Patent: Nov. 19, 2019

(54) FLUID METHOD AND SYSTEM

(71) Applicants: Castrol Limited, Pangbourne, Reading (GB); Steven Paul Goodier, Moulsford (GB); Oliver Paul Taylor, Reading (GB); Michael Baker, Reading (GB); John Gamston, Reading (GB); Krishan Arora, Reading (GB)

(72) Inventors: Steven Paul Goodier, Moulsford (GB); Oliver Paul Taylor, Reading (GB); Michael Baker, Reading (GB); John Gamston, Reading (GB); Krishan Arora, Reading (GB)

(73) Assignee: Castrol Limited, Reading (GB)

( * ) Notice: Subject to any disclaimer, the term of this patent is extended or adjusted under 35 U.S.C. 154(b) by 0 days.

(21) Appl. No.: 15/762,445

(22) PCT Filed: Sep. 23, 2016

(86) PCT No.: PCT/EP2016/072770
§ 371 (c)(1),
(2) Date: Mar. 22, 2018

(87) PCT Pub. No.: WO2017/051015
PCT Pub. Date: Mar. 30, 2017

(65) Prior Publication Data

US 2018/0274408 A1 Sep. 27, 2018

(30) Foreign Application Priority Data

Sep. 23, 2015 (GB) ..... 1516863.6

(51) Int. Cl.
*F01M 11/00* (2006.01)
*F01M 11/04* (2006.01)
(Continued)

(52) U.S. Cl.
CPC ..... *F01M 11/0458* (2013.01); *F01M 11/12* (2013.01); *F01M 13/04* (2013.01);
(Continued)

(58) Field of Classification Search
CPC .... F01M 11/0458; F01M 11/12; F01M 13/04; F01M 2011/043; F01M 2013/0488
See application file for complete search history.

(56) References Cited

U.S. PATENT DOCUMENTS 4,151,823 A 5/1979 Grosse et al.
5,454,354 A 10/1995 Miller
(Continued)

FOREIGN PATENT DOCUMENTS

DE 102012024365 6/2014
WO WO 01/053663 7/2001
(Continued)

*Primary Examiner* — Thomas N Moulis
(74) *Attorney, Agent, or Firm* — McDonnell Boehnen Hulbert & Berghoff LLP

(57) ABSTRACT

A method for controlling fluid distribution in a fluid circulation system associated with an engine, the fluid circulation system being coupled to a replaceable fluid container comprising a fluid supply port configured to couple to a fluid supply line of the fluid circulation system, and a fluid return port configured to couple to a fluid return line of the fluid circulation system, and a breather port configured to couple to a breather output of the fluid circulation system, the method comprising causing the fluid to flow into the replaceable fluid container from the fluid circulation system while inhibiting outflow of the fluid from the replaceable fluid container into the fluid circulation system, so as to collect the fluid in the replaceable fluid container, and related apparatus configured to control fluid distribution in a fluid circulation system associated with an engine, and causing a gas to flow from the replaceable fluid container through the
(Continued)

breather port while inhibiting outflow of the fluid from the replaceable fluid container into the fluid circulation system.

40 Claims, 9 Drawing Sheets

(51) Int. Cl.
*F01M 11/12* (2006.01)
*F01M 13/04* (2006.01)

(52) U.S. Cl.
CPC ..... *F01M 2011/0483* (2013.01); *F01M 2013/0488* (2013.01)

(56) References Cited

U.S. PATENT DOCUMENTS 6,170,505 B1 1/2001 Erwin
6,478,642 B1 * 11/2002 Kolb ..... B63H 20/002 123/196 A
6,896,014 B1 5/2005 Bedi
7,407,594 B2 * 8/2008 Laverdiere ..... B01D 19/0031 210/767
9,869,219 B2 1/2018 Barnes et al.
9,878,822 B2 1/2018 Barnes et al.
9,890,901 B2 2/2018 Brett et al.
9,938,867 B2 4/2018 Brett et al.
2002/0166604 A1 11/2002 Harrison
2004/0159495 A1 8/2004 Erwin et al.
2009/0283363 A1 11/2009 Lockwood et al.
2011/0253092 A1 10/2011 Springer et al.
2013/0048088 A1 2/2013 Miller
2015/0292372 A1 10/2015 Barnes et al.
2015/0292674 A1 * 10/2015 Brett ..... F01M 11/04 220/562
2017/0089234 A1 3/2017 Dawson et al.
2017/0089235 A1 3/2017 Dawson et al.
2017/0089236 A1 3/2017 Andersen et al.
2017/0101911 A1 4/2017 Barnes et al.
2017/0107873 A1 4/2017 Ali et al.
2017/0122151 A1 5/2017 Brett et al.
2017/0183992 A1 6/2017 Barnes et al.
2017/0190466 A1 7/2017 Andersen et al.
2017/0197596 A1 7/2017 Barnes et al.
2018/0258805 A1 9/2018 Goodier et al.
2018/0258806 A1 9/2018 Butterworth et al.
2018/0266288 A1 9/2018 Butterworth et al.
2018/0266873 A1 9/2018 Goodier et al.
2019/0001954 A1 * 1/2019 Ali ..... B60W 10/04
2019/0003369 A1 * 1/2019 Lake ..... B60H 1/00492
2019/0136727 A1 * 5/2019 Lamb ..... F01M 11/04

FOREIGN PATENT DOCUMENTS

WO WO 2014/076314 5/2014
WO WO 2014/076318 5/2014
WO WO 2016/158971 10/2016

* cited by examiner

FLUID METHOD AND SYSTEM

CROSS REFERENCE TO RELATED APPLICATION

This application is a National Phase application of, and claims the benefit of, International (PCT) Application No. PCT/EP2016/072770, filed Sep. 23, 2016, which claims priority to GB Patent Application No. 1516863.6, filed Sep. 23, 2015, each of which is hereby incorporated by reference in its entirety.

This invention relates to a method and an apparatus, and in particular to a method for controlling fluid distribution in a fluid circulation system associated with an engine and a corresponding apparatus.

Many vehicle engines use one or more fluids for their operation. Such fluids are often liquids. For example, internal combustion engines use liquid lubricating oil. Also, electric engines use fluids which can provide heat exchange functionality, for example to cool the engine and/or to heat the engine, and/or to cool and heat the engine during different operating conditions. The heat exchange functionality of the fluids may be provided in addition to other functions (such as a primary function) which may include for example charge conduction and/or electrical connectivity. Such fluids are generally held in reservoirs associated with the engine and may require periodic replacement.

At any time during the life of the engine (such as a stop or an operation of the engine), the reservoirs contain some of the total fluid volume in the vehicle, and the remainder of the total fluid volume is contained in the fluid circulation system (such as a sump and/or a pipework of the fluid circulation system).

For example, conventional periodic replacement of engine lubricating oil in a vehicle engine usually involves draining the oil from the engine sump. The process may also involve removing and replacing the engine oil filter. Such a procedure usually requires access to the engine sump drain plug and oil filter from the underside of the engine, may require the use of hand tools and usually requires a suitable collection method for the drained lubricating oil.

This is complex and expensive.

The draining of the oil may be incomplete. Any oil remaining in the fluid circulation system may contaminate any fresh oil (for example provided by an oil change). It may also be difficult to evaluate the amount of fluid remaining in the fluid circulation system during a fluid change, and thus difficult to provide a constant volume of fluid after any fluid change.

Aspects of the disclosure address or at least ameliorate at least one of the above issues.

Aspects of the present disclosure are recited in the independent claims. Optional features are recited in the dependent claims.

The disclosure extends to:

any apparatus configured to perform at least some of the steps of the method of the disclosure, and/or a fluid circulation system and/or a dock and/or an interface configured to cooperate with a container of any aspect of the disclosure, and/or a system comprising a dock of any aspect of the disclosure and a replaceable fluid container configured to cooperate with a dock of any aspect of the disclosure.

Any feature in one aspect of the disclosure may be applied to other aspects of the disclosure, in any appropriate combination. In particular, features of method aspects may be applied to containers and/or docks and/or systems aspects, and vice versa.

Embodiments will now be described, by way of example only, with reference to the accompanying drawings, in which.

In the drawings, like reference numerals are used to indicate like elements.

Figure 1:
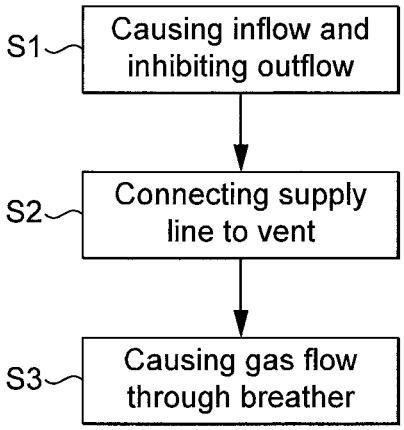
FIG. 1 shows a schematic illustration of an example method for controlling fluid distribution in a fluid circulation system associated with an engine, in accordance with aspects of the disclosure.

As illustrated in FIG. 1, in some aspects of the present disclosure, a method for controlling fluid distribution in a fluid circulation system associated with an engine or a vehicle may comprise causing, at S1, a fluid to flow into a replaceable fluid container, coupled to the fluid circulation system, the flow being from the fluid circulation system, whilst inhibiting outflow of the fluid from the replaceable fluid container into the fluid circulation system, so as to collect the fluid in the replaceable fluid container.

In some examples, inhibiting fluid outflow from the replaceable fluid container may comprise inhibiting fluid flow through the fluid supply port. Alternatively or additionally, in some examples, inhibiting fluid outflow from the replaceable fluid container may comprise controlling a fluid flow in the fluid circulation system to cause a fluid flow through the fluid return port to be greater than a fluid outflow through the fluid return port.

Figure 2B:
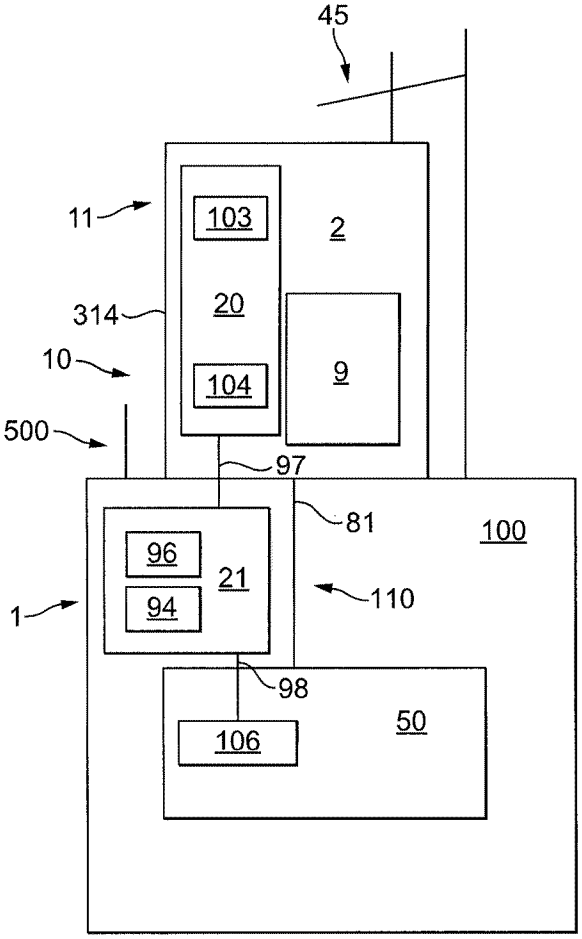
FIG. 2B shows a schematic illustration of an example dock and an example replaceable fluid container, the example container being shown in an engaged condition with the fluid circulation system.
Figure 2A:
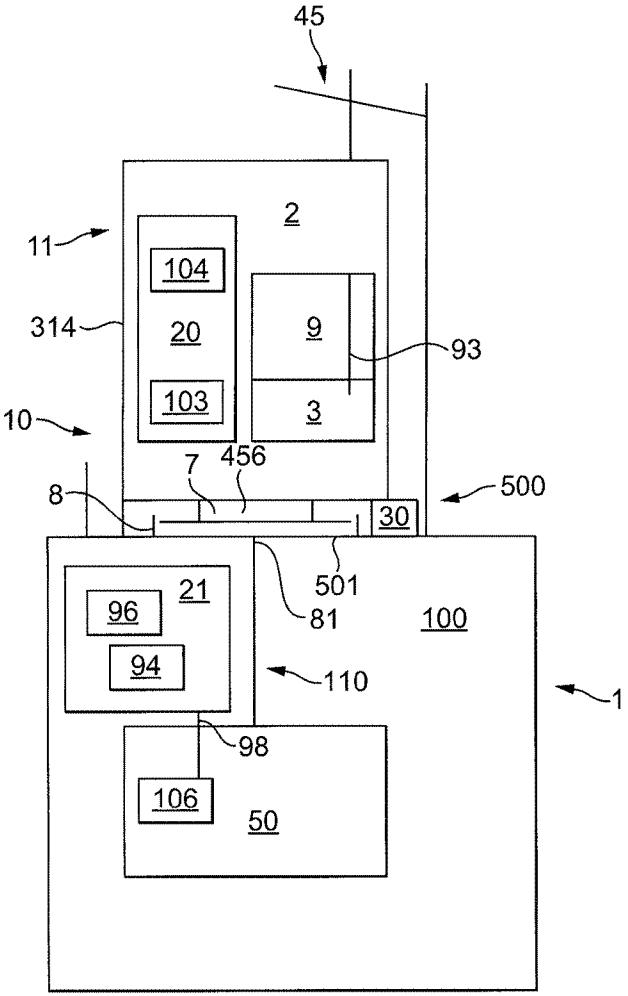
FIG. 2A shows a schematic illustration of an example dock and an example replaceable fluid container, the example container being shown in a disengaged condition from the fluid circulation system.
Figure 3:
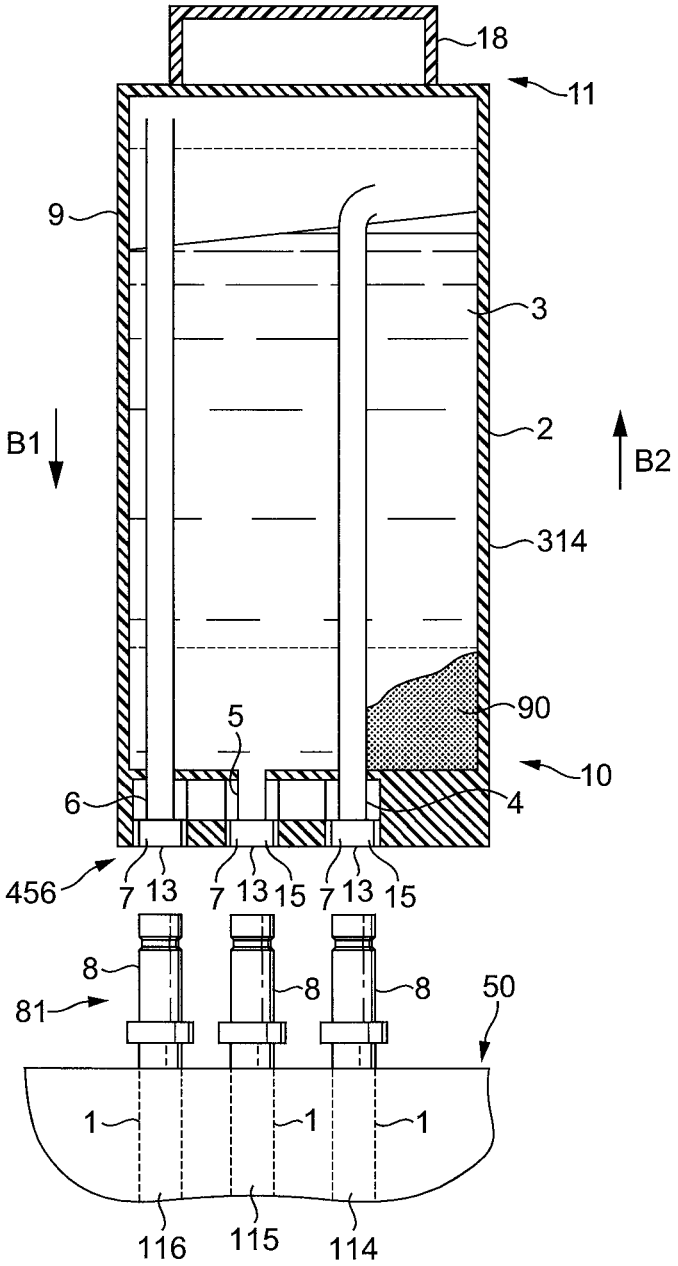
FIG. 3 represents in schematic part cross-section, an example container disconnected from couplings on a vehicle engine.

As described in more detail below and as shown in FIG. 2B, the fluid circulation system may be coupled to the replaceable fluid container, for example optionally via a dock 500, provided on the fluid circulation system 1. In a case where the dock 500 is present on the system 1, the container 2 may be configured to be inserted in the dock 500 (as shown in FIGS. 2A and 2B). Alternatively, when the dock is not present (as shown in FIG. 3), the container 2 may be coupled to the system 1 not comprising the dock.

In some examples, the fluid container comprises a fluid supply port configured to couple to a fluid supply line of the fluid circulation system, and a fluid return port configured to couple to a fluid return line of the fluid circulation system.

The container 2 may be for example for providing fluid to an engine 50 or a vehicle 100. The engine 50 may be for example an engine of the vehicle 100.

In the present disclosure, and as explained in further detail below, "replaceable" means that:

the container can be supplied full with fresh and/or unused fluid, and/or the container can be coupled to the fluid circulation system, in a non-destructive manner, and/or the container can be inserted and/or seated and/or docked in the dock when the dock is present, in a non-destructive manner, and/or the container can be decoupled from the fluid circulation system, in a non-destructive manner, i.e. in a manner which enables its re-coupling should that be desired, and/or the container can be removed from the dock when the dock is present, in a non-destructive manner, i.e. in a manner which enables its re-insertion should that be desired, and/or the same (for example after having been refilled) or another (for example full and/or unused and/or new) container can be re-inserted and/or re-seated and/or re-docked in the dock and/or coupled to the fluid circulation system, in a non-destructive manner.

It is understood that the term "replaceable" means that the container may be "removed" and "replaced" by another new container and/or the same container after having been refilled (in other words the replaceable container may be "refillable") which may be re-inserted in the dock or re-coupled to the fluid circulation system.

In the present disclosure, "in a non-destructive manner" means that integrity of the container is not altered, except maybe for breakage and/or destruction of seals (such as seals on fluid ports) or of other disposable elements of the container.

The fluid container 2, described in more detail below and for example shown in FIGS. 2A and 2B, comprises a body 304 comprising a first, further from the dock, part 11 and a second, closer to the dock, part 10.

The container 2 also comprises the at least one fluid port 456 provided in the first part 10. In some examples the port 456 may optionally comprise a coupling 7 adapted to connect to a corresponding port 81 (for example optionally comprising a coupling 8) on the system 1.

As will be explained in greater detail below, the container 2 may comprise for example two, three or four (or more) fluid ports (such as inlet, outlet or breather ports). The connection between the port 456 and the port 81 is configured to connect, via a fluidic line 110 of the fluid circulation system 1, the fluid container 2 in fluidic communication with the fluid circulation system 1 associated with the engine 50.

In the example illustrated in FIGS. 2A and 2B, the port 456 is shown as being a male element and the port 81 as a female element. It is understood that the port 456 may be a female element and the port 81 a male element, as explained in reference to FIG. 3 and FIG. 8.

In some non-limiting examples, the fluid container 2 may also comprise a data provider 20 arranged for data communication with a control device 21 of the vehicle 100 when the container 2 is engaged with the dock 500 (FIG. 2B) or with the system 1 (not shown in the figures). The data provider 20 is described in greater detail below.

In some examples, the fluid container 2 comprises a reservoir 9 for holding a fluid 3. In some examples, the reservoir may be a specific chamber or the fluid may simply be held in the container. The reservoir 9 of the container 2 may be pre-filled with the fluid 3 before the container 2 is inserted in the dock 500 or provided empty on the vehicle 100.

The fluid 3 may be any type of fluid circulated in the engine 50 and/or circulated in any fluid circulation system associated with the engine 50 (that is the fluid is not necessarily circulated in the engine 50) to support a function of the engine 50 and/or the vehicle 100. The function may be an ancillary function of the engine 50. For example the fluid 3 may be lubricant, and/or coolant, and/or de-icer, and/or any hydraulic fluid such as a fluid used in braking systems, and/or a pneumatic fluid, a washer fluid, a fuel additive or any other fluid associated with any function of the engine and/or the vehicle. Many different types and grades of such fluid are available. As already mentioned, in some non-limiting examples, the fluid 3 may be an engine lubricating oil or an engine heat exchange and/or charge conduction and/or electrical connectivity fluid.

As illustrated in FIG. 2A, in a disengaged (also called "undocked" or "disconnected") condition, the container 2 may be easily seated in the dock 500 and/or removed from the dock 500 by a user and/or operator. To that effect, the container 2 may comprise an actuator 45 configured to be operated between a first condition and a second condition.

As illustrated in FIG. 2A, the actuator 45 is configured, in the first condition, to enable the container 2 to be inserted into the dock 500.

In the docked (also called "engaged" or "connected") condition (FIG. 2B), corresponding to the second condition of the actuator, the container 2 may be fastened to the dock 500, for example using cooperating fastening mechanisms, such as latches, on the container 2 and/or on the dock 500, such as resilient and/or biased mechanisms cooperating and/or interlocking with conforming and/or cooperating mechanisms, such as indents and/or grooves.

As a result, in some examples, in the second condition of the actuator 45, the container 2 cannot be easily removed in a non-destructive manner from the dock 500. In some examples, the actuator 45 needs to be in the first condition to enable the container 2 to be removed from the dock 500.

In some non-limiting examples, in the engaged condition, the data provider 20 may be arranged for data communication with the control device 21.

The dock 500 may be provided on the vehicle 100. One or more docks 500 may be provided on the vehicle 100. The dock 500 may be provided directly proximate to the engine 50, but may also be provided away from the engine 50, such as in the boot or trunk of the vehicle 100.

In the example illustrated in FIG. 3, the container 2 comprises, at the first part 10: at least one fluid supply port 5 (sometimes referred to as "fluid outlet port" or "feed port"), configured to couple to a fluid supply line 115 (sometimes referred to as "supply line") of the fluid circulation system 1, and at least one fluid return port 4 (sometimes referred to as "fluid inlet port" or "scavenge port"), configured to couple to a fluid return line 114 (sometimes referred to as "scavenge line") of the fluid circulation system 1.

Figure 4:
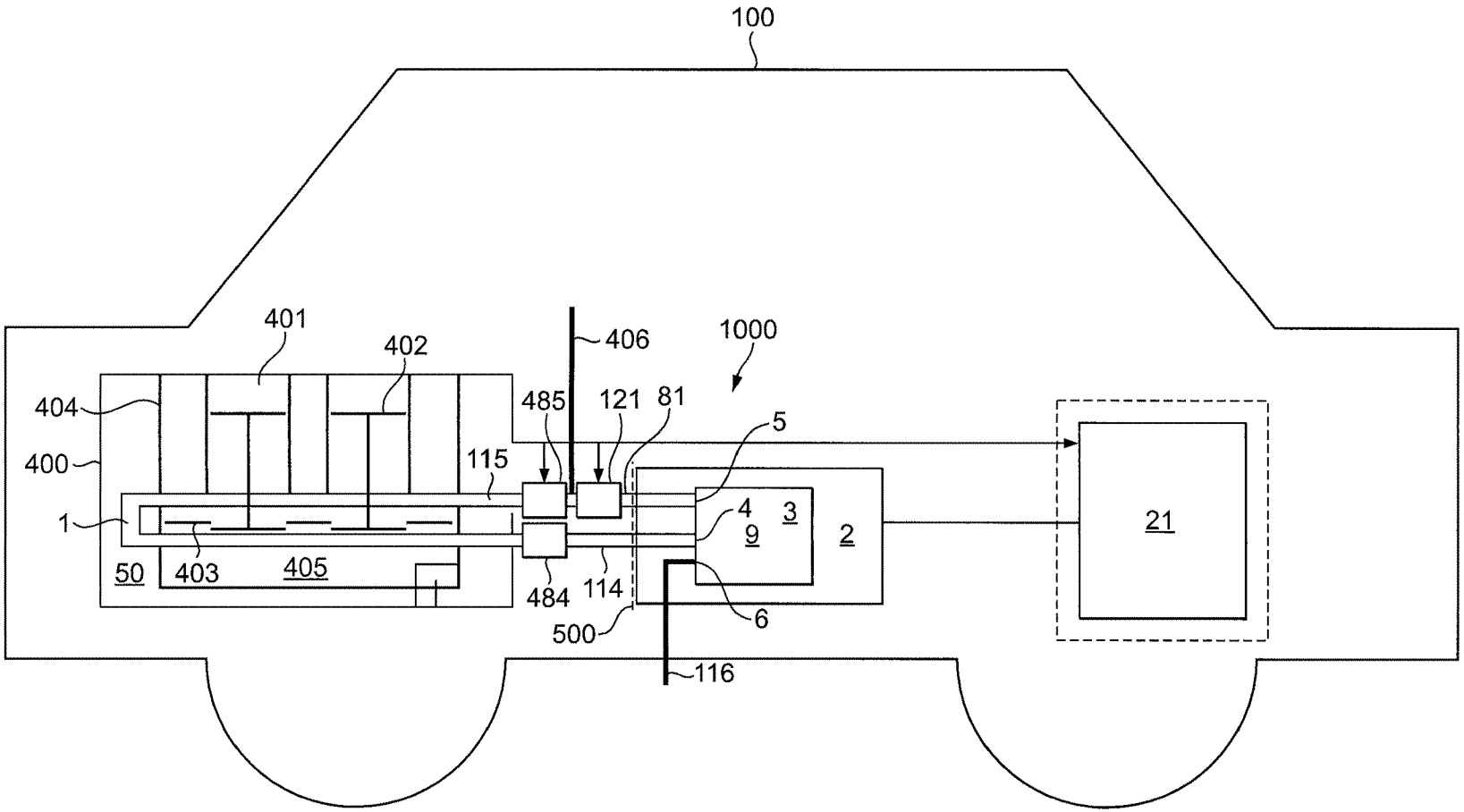
FIG. 4 illustrates a diagrammatic longitudinal cross-section of an example vehicle comprising an example fluid circulation system and an example container, and also comprising examples of an apparatus (e.g. a first example of the apparatus and a fifth example the apparatus) according to the disclosure.

In some examples, as illustrated in FIGS. 3 and 4, the container 2 may further comprise, at the first part 10, at least one breather port 6 (sometimes referred to as "vent port"), configured to couple to a breather output 116 of the fluid circulation system 1.

As illustrated in FIG. 3, the fluid container 2 may comprise a filter 90.

As illustrated in FIG. 3, in some examples, each of said ports 4, 5 or 6 may comprise the couplings 7, for example self-sealing, adapted to connect to the corresponding couplings 8 of the ports 81 on the fluid circulation system 1, to connect said container 2 in fluidic communication with the fluid circulation system 1.

FIG. 4 shows an example of the vehicle 100 comprising the engine 50 and the replaceable container 2. In the example of FIG. 4, the engine 50 also comprises the fluid circulation system 1 associated with the engine 50.

In the example of FIG. 4, the engine is an internal combustion engine. Alternatively or additionally, in some examples, the engine may be an electrical engine or may comprise an electrical engine.

In the example of FIG. 4, the fluid 3 may be a lubricant which may be circulated in the engine 50 and/or may be circulated outside the engine 50. The lubricant container 2 comprises the reservoir 9 for holding the lubricant.

In some examples, the engine 50 may comprise an engine block 400, a combustion chamber 401, at least one piston 402, a crankshaft 403 and a crankcase 404 housing the crankshaft 403. In some examples, the engine 50 of the vehicle 100 may comprise a sump 405 located at the bottom of the engine, below the crankcase 404.

In the example of FIG. 4, the lubricant circulation system 1 is adapted to provide lubricant to the bearings and moving parts of the engine 50, such as the crankshaft 403 housed in the crankcase 404. The engine 50 is configured to receive lubricant from the container 2 via the supply line 115, and to return the lubricant that has circulated in the engine 50 to the container 2 via the lubricant return line 114. The container 2 is coupled to the lubricant circulation system 1 to receive lubricant from return line 114 and to feed the engine via the supply line 115.

In some examples, the sump 405 may be configured to collect the lubricant after the lubricant has lubricated the bearings and moving parts of the engine 50.

In some examples, the sump 405 may be configured as a wet sump and may collect and retain a significant amount of lubricant.

In the example of FIG. 4, the lubricant circulation system 1 may comprise at least one return pump 484, which may be located on the return line 114, for pumping the lubricant from the sump 405 and circulating the lubricant within the system 1 and the engine 50, via the container 2.

Alternatively or additionally, in some examples and as illustrated in FIG. 4, the sump 405 may be configured to collect the lubricant after the lubricant has lubricated the bearings and moving parts of the engine 50, but in some examples, the sump 405 may be configured as a dry sump. When configured as a dry sump, the sump 405 may not be configured to retain a significant amount of lubricant. The return pump 484 may act as a scavenging pump such that no significant amount of lubricant is retained in the sump 405. The return pump 484 may cause the fluid to flow into the replaceable fluid container by pumping the fluid into the container. It should be understood that causing the fluid to flow into the replaceable fluid container may comprise, alternatively or additionally, drawing the fluid into the container using a vacuum system (not shown in the Figures).

Alternatively or additionally, the lubricant circulation system 1 may comprise at least one supply pump 485, which may be located on the supply line 115, for circulating the lubricant within the system 1, from the container 2 to the engine 50.

In some examples, the return pump 484 and/or the supply pump 485 are powered and/or driven by the engine 50 and/or by an electrical power source. In some examples, the return pump 484 and/or the supply pump 485 may be power-supplied by the operation of the engine 50 (such as by using the rotation of the engine, such as powered by a crankshaft of the engine) and/or driven by the engine 50 (such as driven by a crankshaft of the engine). In some examples, the electrical power source may be part of the engine (for example when the engine is a hybrid engine) and/or may be part of the battery of the vehicle 100. Alternatively or additionally, the electrical power source may be an extra, dedicated, power source. In some examples, the electrical power source may be an electrical power source which is external to the vehicle 100.

In some examples, the pump 484 and/or the pump 485 are powered individually. Alternatively or additionally, the pump 484 and/or the pump 485 are driven by a common element (such as the engine and/or the electrical power source).

As will be described in greater detail below, in some examples inhibiting fluid flow through the fluid supply port may comprise blocking the fluid supply port 5 and/or blocking the fluid supply line 115.

In the present disclosure blocking of a port and/or a line may be caused by any manner suitable for inhibiting the fluid flow, and may include at least one of:

placing a blind face (e.g. of the dock 500 when present and/or of the system 1 when the dock is not present) in front of the port and/or the line, and/or closing a valve in front of the port and/or the line, and/or not opening and/or maintaining closed a self-sealing coupling and/or valve of the port and/or the line.

As will be described in greater detail below, in some examples, causing as shown at FIG. 1, at S1, the fluid 3 to flow into the replaceable fluid container 2 from the fluid circulation system 1 may comprise operating the pump 484, for example by cranking the engine without firing the engine, to collect the fluid in the container 2.

As explained in greater detail below, with reference to FIGS. 1 and 4, the example method for controlling fluid distribution in the fluid circulation system 1 may further comprise, at S2, optionally connecting the fluid supply line 115 to a vent 406 whilst inhibiting outflow of the fluid from the replaceable fluid container into the fluid circulation system. In some examples, the vent 406 may enable the pump 485 to pump gas (such as vapour and/or air) from the vent 406 (for example even when the port 5 is blocked) and to avoid excessive negative pressure on the supply line 115.

As explained in greater detail below, with reference to FIGS. 1 and 4, the example method for controlling fluid distribution in the fluid circulation system 1 may further comprise, at S3, optionally causing a gas (such as vapour and/or air) to flow from the replaceable fluid container through the breather port whilst inhibiting outflow of the fluid from the replaceable fluid container into the fluid circulation system. In some examples, the breather output 116 may enable the pump 484 to pump fluid to the container, causing the fluid to push gas (such as vapour and/or air) from the container through the port 6 and breather output 116 (for example even when the port 5 is blocked) and to avoid pressurising the container 2 and/or the return line 114 during operation of the pump 484.

Alternatively or additionally, in some examples inhibiting fluid flow through the fluid supply port may comprise disabling a pump causing the outflow through the fluid supply port 5 and/or the fluid supply line 115. In some examples inhibiting fluid flow through the fluid supply port may comprise disabling the pump 485.

FIG. 4 shows a schematic view of a non-limiting example of a first example of an apparatus 1000 configured to perform at least some of the steps of the example method of the disclosure shown in FIG. 1.

In the example of FIG. 4, the apparatus 1000 comprises a valve 121 configured to:

enable circulation of fluid from the port 5 of the container 2 to the line 115 in an open condition, and block the fluid supply line 115 and/or the fluid supply port 5 in a closed condition.

In some examples the valve 121 may be actuated from the open condition to the closed condition (or vice versa) by a user (i.e. manually) and/or an actuator controlled by a controller (i.e. for example mechanically and/or electrically). As shown in the example of FIG. 4, the valve 121 may be controlled by the engine control device 21.

As shown in the example of FIG. 4, the valve 121 is located on the fluid supply line 115. In some examples, the valve 121 may be located in the proximity of the port 81 on the line 115. Alternatively, the valve 121 may be located further downstream in the pipework of the system 1. Alternatively, the valve 121 may be located in the container 2. In some examples, the apparatus 1000 may comprise a plurality of valves 121 which may be located in the container 2 and/or on the fluid supply line 115.

In operation, as shown in FIG. 1, inhibiting at S1 the fluid flow through the fluid supply port 5 comprises actuating the valve 121 from the open condition to the closed condition.

In some examples, causing, at S1, the fluid 3 to flow into the replaceable fluid container 2 from the fluid circulation system 1 may comprise operating the pump 484, for example by cranking the engine without firing the engine, to collect the fluid in the container 2. An electrical signal received by the control device 21 may, for example, inform the vehicle control device 21 of the condition of the valve 121 (this may be provided by an electrical sensor coupled to the valve 121 and configured to send a signal to the vehicle control device 21 when ignition is turned on). The control device 21 may then ensure that the engine 50 does not fire with the valve 121 in the closed condition (i.e. port 5 and/or line 115 blocked). Alternatively or additionally, the electrical signal may be provided by a sensor configured to measure fluid pressure during cranking. The vehicle control device 21 may allow firing of the engine only when a fluid pressure level greater than a predetermined fluid pressure level has been reached.

As illustrated by FIG. 4, in some examples, the valve 121 may further be configured to maintain open a connection between the fluid supply line 115 and the vent 406. In some examples, the valve 121 is located in the system 1 so as not to interfere with the connection between the fluid supply line 115 and the vent 406. The connection to the vent 406 may enable the pump 485 to pump gas (such as vapour and/or air) from the vent 406 (for example even when the port 5 is blocked) and to avoid excessive negative pressure on the supply line 115 when the valve 121 is in the closed condition.

Alternatively or additionally, in some examples the valve 121 may act as a flow restrictor and/or a throttle (i.e. the valve may have a plurality of intermediate conditions between the closed or open conditions) and may enable control the fluid flow on the supply line 115 and/or the fluid supply port.

Figure 5A:
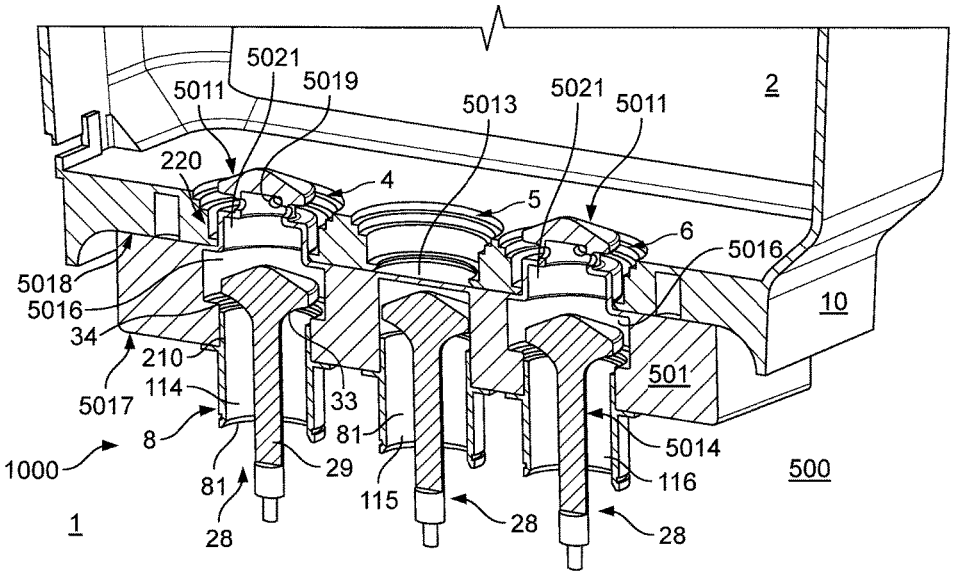
FIGS. 5A and 5B illustrate a second example of an apparatus according to the disclosure.
Figure 5B:
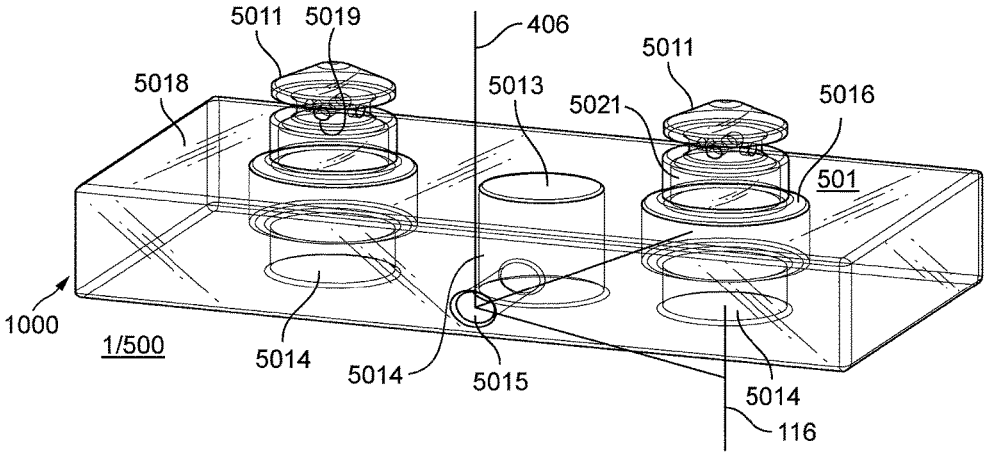

FIGS. 5A and 5B show, in a schematic longitudinal cross-section (FIG. 5A) and in a wire-frame view (FIG. 5B), a non-limiting example of a second example of an apparatus 1000 configured to perform at least some of the steps of the example method of the disclosure (shown in FIG. 1).

In a normal use condition, not shown in FIGS. 5A and 5B, the apparatus is not present (i.e. the apparatus is not connected to the dock or the system) and the container is docked with:

the fluid circulation system when a dock is not present (as already stated, the dock 500 is optional), and/or the dock when a dock is present.

In the normal use condition, circulation of fluid from the port 5 of the container 2 to the line 115 is enabled, as well as circulation of fluid to the port 4 of the container 2 from the line 114.

The apparatus 1000 of FIGS. 5A and 5B may be operated in a blocking condition, different from the normal use condition.

In some examples, changing the operation from the operation in the normal use condition into the operation in the blocking condition may comprise:

disengaging the container 2 from the dock when a dock is present or from the fluid circulation system 1 when a dock is not present, inserting the apparatus 1000 in the dock when a dock is present or on the fluid circulation system when a dock is not present, engaging the apparatus 1000 with the dock or the fluid circulation system, re-inserting the container 2 in the dock or on the fluid circulation system when a dock is not present, and engaging the container 2 and the apparatus 1000 with one another.

FIG. 5A schematically illustrates the blocking condition, different from the normal use condition, where the fluid is enabled to flow into the replaceable fluid container whilst the outflow of the fluid from the replaceable fluid container into the fluid circulation system is inhibited. In the example of FIG. 5A, the container 2 is engaged with the apparatus 1000, and the apparatus 1000 is engaged with the dock 500.

In the example of FIGS. 5A and 5B, the apparatus 1000 comprises an interface 501 (sometimes referred to as a "insert" interface) which is configured to be located (as shown in FIG. 5A) between:

the container 2 and the fluid circulation system 1 when a dock is not present, and/or the container 2 and the dock 500 when a dock is present.

In some examples the interface 501 may comprise a block of material (such as metal and/or hard plastics), having the appropriate shape as explained below.

In some examples and as shown in FIG. 5A, the interface 501 may be configured to block the fluid supply port 5 and maintain open the fluid return port 4. It is understood that the interface 501 may be configured to:

disable (e.g. close or maintain closed) the fluid supply port 5 (and/or any corresponding valves as explained below) for inhibiting outflow of fluid from the container 2, and activate (e.g. open or maintain open) the fluid return port 4 (and/or any corresponding valves as explained below) for collecting fluid in the container 2.

In some examples, the interface 501 may comprise a system-facing part 5017 configured to cooperate with the optional dock 500 when the dock is present and/or the fluid circulation system 1 when a dock is not present.

In the example of FIG. 5A, the ports 81 of the lines 114 and 115 and output 116 of the system 1 comprise male elements 210. In the example of FIGS. 5A and 5B, the system-facing part 5017 of the interface 501 comprises female elements 5014 to cooperate with the male elements 210 of the ports 81.

In the example of FIG. 5A, each of the ports 81 of the system 1 may comprise the self-sealing coupling 8 which may comprise a self-sealing valve 28 which is biased to a closed position when the container 2 and the fluid system 1 and/or the dock 500 are disconnected. The valve 28 may comprise an axially moveable element 29 and a valve face 33 which, when in the closed position (not shown in FIGS. 5A and 5B), may rest against a valve seat 34 of the ports 81, in order to seal the corresponding port 81 to prevent or at least inhibit fluid flow through the closed valve 28. When the valve 28 is in the open position (FIG. 5A), the valve face 33 does not rest against the valve seat 34 of the ports 81, and thus allows fluid to flow through the open valve 28. It should be understood that other types of self-sealing coupling may be envisaged, as will be apparent from the present disclosure.

In the example of FIGS. 5A and 5B, some of the female elements 5014 (e.g the female elements 5014 connected to the return line 114 and the breather output 116 in the example of FIG. 5A) may comprise a peripheral recess 5016 configured to accommodate the axially moveable element 29 and the valve face 33 in the open position of the valve 28.

In some examples, the interface 501 may comprise a container-facing part 5018 configured to cooperate with the part 10 of the container 2.

In the example of FIG. 5A, the ports 4, 5 or 6 of the container 2 comprise female elements 220. In the example of FIGS. 5A and 5B, the container-facing part 5018 of the interface 501 comprises male elements 5011 (two male elements 5011 in the FIGS. 5A and 5B) defining an outer surface configured to cooperate with the female elements 220 (FIG. 5A) of the ports 4 (fluid return port) and 6 (breather port). When the male elements 5011 cooperate with the female elements 220 of the ports 4 and 6 (FIG. 5A), the ports 4 and 6 are maintained open.

In the example of FIGS. 5A and 5B, the male elements 5011 also comprise an inner surface defining an inner chamber 5021 in fluidic connection with the recess 5016.

In the example of FIG. 5A, each of the male elements 5011 may comprise an orifice 5019 in fluidic connection with the inner chamber 5021.

In the example of FIGS. 5A and 5B, the fluidic connection of the recess 5016, the inner chamber 5021 and the orifice 5019 enables fluid to flow from the recess 5016 (coming from the valve 28 in an open position) to the container 2 through the port 4 when the apparatus 1000 is operated in the blocking condition (i.e. when the container 2 is engaged with the interface 501 and the interface 501 is engaged with the fluid system 1 or the dock 500). The fluid may be collected in the container 2.

In the example of FIG. 5A, the fluidic connection of the recess 5016, the inner chamber 5021 and the orifice 5019 enables gas (such as vapour and/or air) to flow to and/or from the recess 5016 (coming from or going to the valve 28 in an open position) to and/or from the container 2 through the port 6 when the apparatus 1000 is operated in the blocking condition. The fluidic connection of the breather line 116 with the port 6 enables avoiding pressurising the container 2 during operation for example of the pump 484.

In the example of FIGS. 5A and 5B, the container-facing part 5018 of the interface 501 also comprises a blocking element 5013. As can be seen in the example of FIGS. 5A and 5B, the interface 501 is thus configured to inhibit outflow of the fluid from the replaceable fluid container 2 into the fluid circulation system 1 by inhibiting fluid flow through the fluid supply port 5.

The blocking element 5013 forms a blind surface inhibiting flow of fluid. Moreover, the blocking element 5013 is configured to maintain the fluid supply port 5 closed. In some examples, the blocking element 5013 does not cooperate with the female elements 220 of the port 5 (fluid supply port). It should be thus understood that in the example of FIG. 5A, the interface 501 is configured to block the fluid supply port 5 and block the fluid supply line 115, even if the valve 28 connected to the supply line 115 is open.

In some examples, causing the fluid to flow into the replaceable fluid container, at S1 as shown in FIG. 1, may further comprise operating the pump 484, for example by cranking the engine without firing the engine, to collect the fluid in the container 2. An electrical signal received by the control device 21 may, for example, inform the vehicle control device 21 when the apparatus 1000 is present, to prevent undesirable firing of the engine 50. The electrical signal may be provided by a sensor configured to measure fluid pressure during cranking. The vehicle control device 21 may allow firing of the engine only when a fluid pressure level greater than a predetermined pressure level has been reached.

As already stated, the supply line 115 may be connected to the pump 485 (FIG. 4). As shown diagrammatically in FIG. 5B, the interface 501 may comprise a fluidic connection 5015 configured to connect the fluid supply line 115 to the vent 406 of the fluid circulation system 1 (via the female element 5014). The connection to the vent 406 may enable the pump 485 to pump gas from the vent 406 (for example even when the port 5 is blocked) and to avoid excessive negative pressure on the supply line 115. In some examples, the fluidic connection 5015 may be connected to the vent 406, for example open to an ambient atmosphere, for example via a filter. Alternatively or additionally, as shown diagrammatically in FIG. 5B, the fluidic connection 5015 may be configured to connect the fluid supply line 115 (via the female element 5014) to the breather port 6 illustrated in FIG. 5A (via e.g. the recess 5016, the inner chamber 5021 and the orifice 5019 connected to the breather port 6 illustrated in FIG. 5A) and/or to the breather output 116.

It should be understood that the interface 501, when in place on the dock 500 or the system 1, covers or extends over, at least partly, the ports 81 of the system 1. The interface 501, when in place on the dock 500 or the system 1, may thus enable protection of the ports 81 of the system 1, by preventing or at least inhibiting the ports 81 of the system 1 from being damaged by an accidental and/or unintentional shock on the ports 81, when the container 2 is not engaged with (e.g. disconnected and removed from) the system 1 and/or dock 500.

In the example of FIG. 5A, the open ports 4 and 6 are located on each side of the closed port 5, which is thus located between the open ports 4 and 6. It is understood that having active valves and/or ports on each side of the container may improve alignment of the container in the dock and/or minimise tilt of the container 2 caused by flow of fluid through the ports 4 and 6.

Figure 6A:
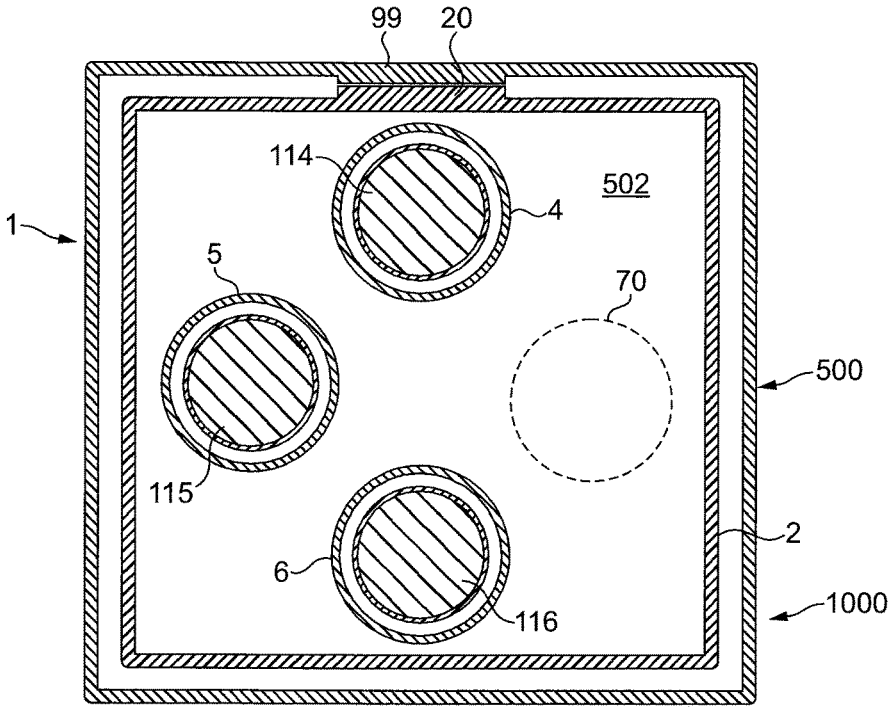
FIGS. 6A and 6B illustrate a cross-section of a third example of an apparatus according to the disclosure.
Figure 6B:
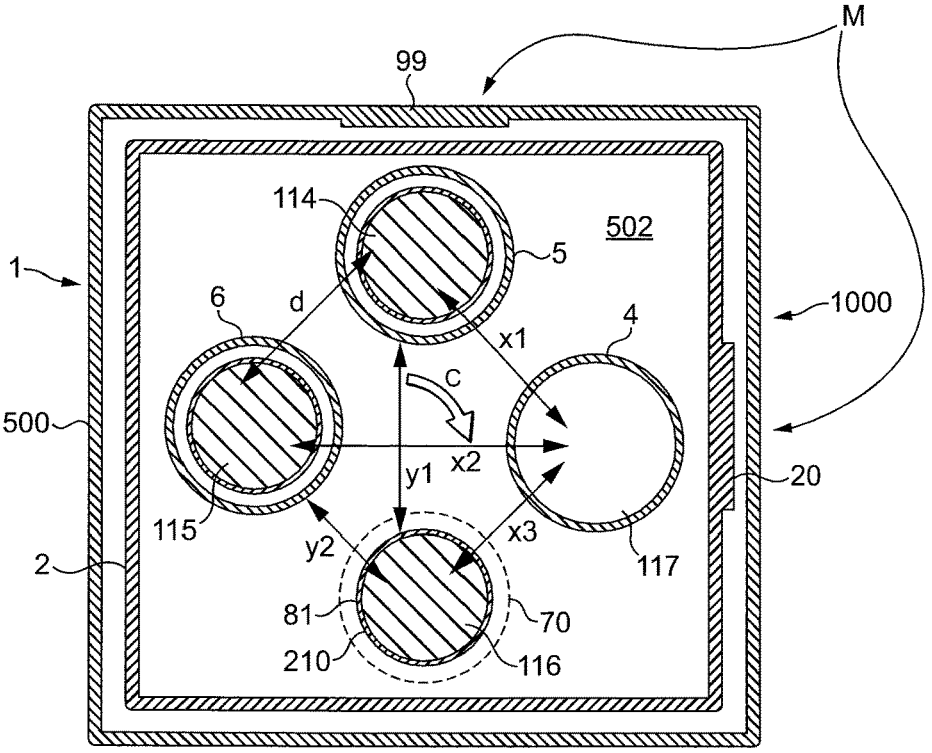

FIGS. 6A and 6B show, in schematic cross-section, a non-limiting example of a third example of an apparatus 1000 configured to perform at least some of the steps of the example method of the disclosure (shown in FIG. 1).

The apparatus 1000 may comprise an interface 502 (sometimes referred to as a "reversible" interface) which may be provided on the container 2 and/or on the fluid circulation system 1 when no dock is present and/or the dock 500 when the dock is present.

In some examples and as shown in FIGS. 6A and 6B, the interface 502 may be provided on the container 2.

The apparatus of FIGS. 6A and 6B is configured to be operated in a normal use spatial configuration (FIG. 6A) and in a blocking spatial configuration (FIG. 6B). The interface 502 of the apparatus 1000 is configured to enable the container 2 to be docked with the fluid circulation system when a dock is not present or with the dock when a dock is present, both in the normal use spatial configuration (FIG. 6A) and in the blocking spatial configuration (FIG. 6B).

As shown in FIG. 6A, in the normal use spatial configuration:

the fluid supply port 5 is coupled to the fluid supply line 115, and the fluid return port 4 is coupled to the fluid return line 114.

Therefore, in the normal use spatial configuration, circulation of fluid from the port 5 of the container 2 to the line 115 is enabled, as well as circulation of fluid to the port 4 of the container 2 from the line 114.

As shown in FIG. 6A, in the normal use spatial configuration, the breather port 6 is coupled to the breather output 116. Therefore, in the normal use spatial configuration, circulation of gas (such as vapour and/or air) from or to the port 6 of the container 2 to or from the output 116 is enabled.

In some examples, changing the operation from the operation in the normal use spatial configuration (FIG. 6A where the container is coupled to the dock or the system) into the operation in the blocking spatial configuration (FIG. 6B) may comprise:

disengaging the container 2 from the dock when a dock is present or from the fluid circulation system 1 when a dock is not present, changing the spatial orientation of the fluid container 2 with respect to the dock 500 or the system 1, i.e. from the spatial orientation shown in FIG. 6A to the spatial orientation shown in FIG. 6B, as shown by arrow C (for example clockwise by 90 degrees as shown by arrow C), re-inserting the container 2 in the dock or on the fluid circulation system when a dock is not present, and re-coupling the fluid container 2 with respect to the fluid circulation system 1 by engaging the container 2 with the dock or with the fluid circulation system when a dock is not present (FIG. 6B).

FIG. 6B schematically illustrates the blocking spatial condition, different from the normal use spatial condition, where the fluid is enabled to flow into the replaceable fluid container whilst the outflow of the fluid from the replaceable fluid container into the fluid circulation system is inhibited.

As explained below, in the blocking spatial configuration, the change of orientation of the container with respect to the dock or the system causes the fluid supply port 5 to be spatially separated from the fluid supply line 115. In the example of FIG. 6B, the spatial separation is represented by distance d. As explained below, in the blocking spatial configuration, the container 2 has rotated by 90° with respect to the normal use spatial configuration, so that the function of the dock ports has changed as explained below.

As shown in FIG. 6B, in the blocking spatial configuration, the fluid supply port 5 of the container is coupled to the fluid return line 114 of the fluid circulation system 1. In operation in the blocking spatial configuration, in some examples, causing, at S1 as shown in FIG. 1, the fluid 3 to flow into the replaceable fluid container 2 from the fluid circulation system 1 may comprise returning fluid from the return line 114 to the container 2 (for example by operation of the pump 484 (FIG. 4)), but into the supply port 5 of the container (instead of the return port 4 in the normal spatial configuration). Fluid is collected in the container 2. Connection between the return line 114 and the supply port 5 may allow minimising back pressure on the return line 114.

As shown in FIG. 6B, in the blocking spatial configuration, the change of orientation of the container 2 causes the fluid return port 4 to be spatially separated from each of:

the return line 114 (by the spatial separation represented by distance x1); or the supply line 115 (by the spatial separation represented by distance x2), or the breather output 116 (by the spatial separation represented by distance x3).

In the example of FIG. 6B, the change of orientation of the container 2 with respect to the dock or to the system causes the fluid return port 4 to be blocked. In the example of FIG. 6B, the blocking of the fluid return port 4 may be caused by:

placing a blind face 117 (e.g. of the dock 500 when the dock is present and/or of the system 1 when the dock is not present) in front of the port 4, and/or not opening and/or maintaining closed a self-sealing coupling and/or valve of the port 4 (as the self-sealing coupling and/or valve of the port 4 may not be activated by any of the lines 114 or 115 or the output 116 because of the distances x1, x2 and x3, respectively).

In some examples, the return port 4 of the container may thus be blocked shut. Outflow of the fluid from the replaceable fluid container from the return port 4 is thus inhibited and the fluid is collected in the container 2.

As shown in FIG. 6B, in the blocking spatial configuration, the breather port 6 is coupled to the fluid supply line 115 of the fluid circulation system 1. In operation in the blocking spatial configuration, operation of the pump 485 for example (FIG. 4) enables gas (such as vapour and/or air) to be drawn into the pressure pump 485 and/or in the fluid circulation system 1. The connection of the port 6 with the line 115 may also enable removal of the negative pressure from the pump 485 and/or to minimise pressure in the container during filling by operation of the pump 484.

It should be understood that in some examples, only gas (such as vapour and/or air) may pass through the breather port 6 coupled to the fluid supply line 115 in the blocking spatial configuration, not fluid (such as oil for example). The outflow of the fluid from the replaceable fluid container into the fluid circulation system through the breather port 6 is thus inhibited and the fluid is collected in the container 2.

As shown in FIG. 6B, in the blocking spatial configuration, the change of orientation of the container 2 causes the breather output 116 to be spatially separated from each of:

the return port 4 (by the spatial separation represented by distance x3); or the supply port 5 (by the spatial separation represented by distance y1), or the breather port 6 (by the spatial separation represented by distance y2).

In the example of FIG. 6B, the change of orientation of the container 2 with respect to the dock or to the system causes the breather output 116 to be blocked. In the example of FIG. 6B, the blocking of the breather output 116 may be caused by:

placing a blind element 70 (e.g. of the container 2) in front of the breather output 116, and/or not opening and/or maintaining closed a self-sealing coupling and/or valve of the breather output 116 (as the self-sealing coupling and/or valve of the breather output 116 may not be activated by any of the ports 4 or 5 or 6 because of the distances x3, y1 and y2, respectively).

In operation in the blocking spatial configuration, in some examples, causing, at S1, the fluid 3 to flow into the replaceable fluid container 2 from the fluid circulation system 1 may comprise operating the pump 484, for example by cranking the engine without firing the engine, to collect the fluid in the container 2, with, as explained above, the container 2 rotated by 90° so that the function of the dock ports changes as explained above. An electrical signal received by the control device 21 may, for example, inform the vehicle control device 21 of the position of the container in the dock (this may be provided by detection of a misalignment M of the data provider 20 of the container from a data receiver interface 99 of the dock or the system). Alternatively or additionally, the electrical signal may be provided by a sensor configured to measure fluid pressure during cranking. The vehicle control device 21 may allow firing of the engine only when a fluid pressure level greater than a predetermined pressure level has been reached.

In the case where the port 81 of the breather output 116 comprises a male element 210, the element 70 of the interface 502 may comprise a female element configured to accommodate the male element 210 in the blocking spatial configuration (FIG. 6B). In the normal use spatial configuration (FIG. 6A), the female element 70 may be not coupled to any of the ports 114, 115 or outlet 116 of the fluid system 1. It should be understood that the male elements 210 could also be provided on the container 2 and the female elements on the dock 500 and/or system 1.

Figure 7A:
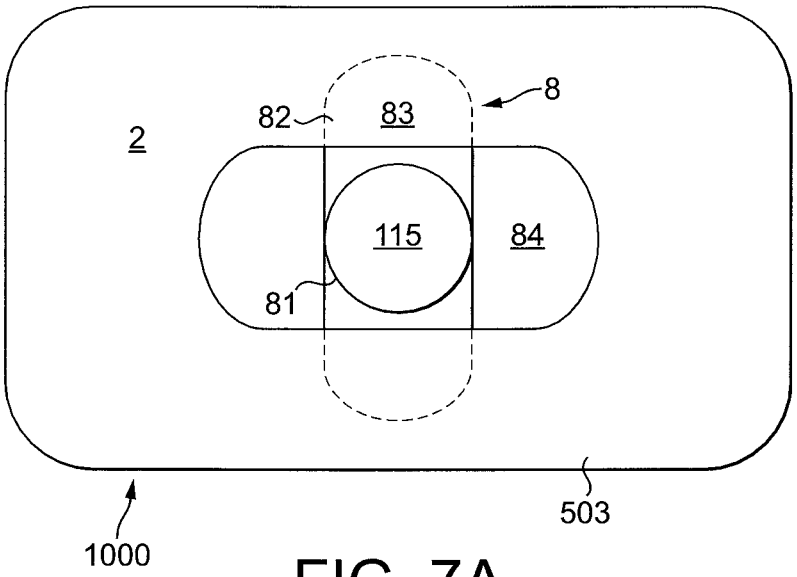
FIGS. 7A and 7B illustrate an example of a detail of a fourth example of an apparatus according to the disclosure.
Figure 7B:
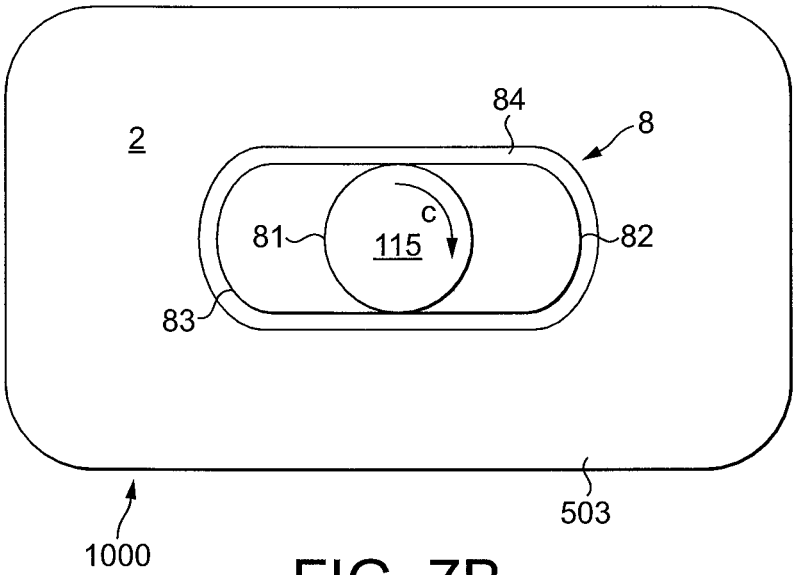

FIGS. 7A and 7B show, in schematic cross-section, a non-limiting example of a detail of a fourth example of an apparatus 1000 configured to perform at least some of the steps of the example method of the disclosure (FIG. 1).

The apparatus 1000 may comprise an interface 503 (sometimes referred to as an "indexed" interface) which may be provided on the container 2 and/or on the fluid circulation system 1 when a dock is not present and/or the dock 500 when a dock is present. In some examples and as shown in FIGS. 7A and 7B, the interface 503 may be provided on the dock 500 or on the system 1 when a dock is not present (such as on the line 115).

It should be understood that FIGS. 7A and 7B only represent a part of the interface 503 which may be provided on the line 115, because the interface 503 is configured not to interfere with the coupling of the port 4 with the line 114 or with the coupling of the port 6 with the output 116 (not shown in FIGS. 7A and 7B but explained in reference to FIGS. 2A and 2B or FIG. 3 for example).

The apparatus 1000 of FIGS. 7A and 7B is configured to be operated in a normal use configuration (FIG. 7A) and in a blocking configuration (FIG. 7B). The interface 503 of the apparatus 1000 is configured to enable the container 2 to be docked with the fluid circulation system when a dock is not present or with the dock when a dock is present, both in the normal use configuration (FIG. 7A) and in the blocking configuration (FIG. 7B).

As shown in FIG. 7A, in the normal use spatial configuration the apparatus is configured to activate (e.g. open or maintain open) the fluid supply port 5 (and/or any corresponding valves as explained below) for supplying fluid from the container 2. Therefore, in the normal use configuration, circulation of fluid from the port 5 of the container 2 to the line 115 is enabled (FIG. 7A), as well as circulation of fluid to the return port of the container from the return line (not shown in FIGS. 7A and 7B but as described in reference to e.g. FIGS. 2A and 2B or FIG. 3). It should be understood that in the normal use configuration, the breather port is also coupled to the breather output (not shown in FIGS. 7A and 7B but as described in reference to e.g. FIGS. 2A and 2B or FIG. 3). Therefore, in the normal use configuration, circulation of gas (such as vapour and/or air) from or to the breather port of the container to or from the breather output is enabled.

In some examples, operation in the blocking configuration (FIG. 7B) from the normal use configuration (FIG. 7A where the container is coupled to the dock or the system) may comprise:

disengaging the container 2 from the dock when a dock is present or from the fluid circulation system 1 when a dock is not present, changing the orientation of the interface 503 of the apparatus whilst maintaining unchanged the orientation of the fluid container 2 with respect to the dock or the system 1. In some examples, the change of orientation of the interface 503 includes changing from the spatial orientation shown in FIG. 7A to the spatial orientation shown in FIG. 7B, as shown by arrow C (for example clockwise by 90 degrees as shown by arrow C), re-inserting the container 2 in the dock or on the fluid circulation system when a dock is not present, and re-coupling the fluid container 2 with respect to the fluid circulation system 1 by engaging the container 2 with the dock or with the fluid circulation system when a dock is not present (FIG. 7B).

FIG. 7B schematically illustrates the blocking condition, different from the normal use condition, where the fluid is enabled to flow into the replaceable fluid container (through the return line and the return port, not shown in FIG. 7B, similarly as in the normal use condition, as the interface 503 does not interfere with the return line or the return port), whilst the outflow of the fluid from the replaceable fluid container into the fluid circulation system is inhibited. In some examples and as shown in FIG. 7B, the interface 503 may be configured, in the blocking configuration, to block the fluid supply port 5 (whilst not interfering with the fluid return port, not shown in FIG. 7B).

As explained below, in the blocking configuration, the change of orientation of the interface 503 with respect to the container causes the coupling between the fluid supply port and the fluid supply line not to be made.

In the example of FIG. 7B, in the blocking configuration, the fluid supply port 5 is not coupled to the fluid supply line 115 of the fluid circulation system 1. In operation in the blocking configuration, in some examples, causing, at S1 as shown in FIG. 1, the fluid 3 to flow into the replaceable fluid container 2 from the fluid circulation system 1 may comprise returning fluid from the return line (not shown in FIG. 7B) to the container (for example by operation of the pump 484 (FIG. 4)) into the return port 4 (not shown in FIG. 7B) of the container. Fluid is collected in the container 2. Inhibiting outflow of the fluid from the replaceable fluid container into the fluid circulation system may be made by inhibiting fluid flow through the fluid supply port as the coupling between port and the fluid supply line is not made.

In the example of FIG. 7B, the blocking of the fluid supply port 5 may be caused by:

not opening and/or maintaining closed a self-sealing coupling and/or valve of the port 5 (as the self-sealing coupling and/or valve of the port 5 may not be activated by the line 115 because of the coupling not being made), and/or placing a closed self-sealing coupling and/or valve of the line 115 in front of the port 5 (as the self-sealing coupling and/or valve of the line 115 may not be activated by the port 5 because of the coupling not being made).

In the example of FIGS. 7A and 7B, the fluid supply line 115 comprises the coupling 8 configured to be operated between the normal use configuration (FIG. 7A) and the blocking configuration (FIG. 7B). In the blocking configuration of the coupling 8, coupling between the fluid supply port 5 and the fluid supply line 115 is not made. In some examples, the coupling 8 may comprise a cam 83 configured to cooperate with a cam-engaging surface 82 and/or a recess 84 provided on the container, such that: the coupling is made in FIG. 7A (by cooperation of the cam 83 with the cam-engaging surface 82) and the coupling is not made in FIG. 7B (because the cam 83 is located in the recess 84, and as explained above the fluid supply port 5 and/or the line 115 may not open and/or a self-sealing coupling and/or valve of the port 5 and/or of the line 115 may be maintained closed).

In some examples, the cam 83 may be locked into position when oriented, for example to ensure it does not rotate under engine and/or vehicle vibration conditions (which may cause undesirable de-activation of the port 5).

An electrical signal received by the control device 21 may, for example, inform the vehicle control device 21 of the position of the cam 83 (this may be provided by an electrical sensor configured to send a signal to the vehicle control device 21 when ignition is turned on). The control device 21 may then ensure that the engine 50 does not fire with the cam 83 in the blocking condition (i.e. port 5 and/or line 115 blocked). Alternatively or additionally, the electrical signal may be provided by a sensor configured to measure fluid pressure during cranking. The vehicle control device 21 may allow firing of the engine only when a fluid pressure level greater than a predetermined fluid pressure level has been reached.

With reference to FIG. 4, it is shown a non-limiting example of a fifth apparatus 1000 configured to perform at least some of the steps of the example method of the disclosure.

In some examples, inhibiting the fluid flow through the fluid supply port may comprise disabling a pump and/or a vacuum system causing the outflow through the fluid supply port and/or the fluid supply line. In the example of FIG. 4, the apparatus comprises the control device 21 configured to disable the pump and/or the vacuum system causing the outflow through the fluid supply port 5 and/or the fluid supply line 115.

In some examples the control device 21 may be configured to disable the pump 485 and causing the pump 484 to operate.

In some examples, the pump 484 may form at least a part of the pump 485, or vice versa.

In some examples, inhibiting the fluid outflow from the replaceable fluid container may comprise controlling the fluid flow in the fluid circulation system to cause a fluid flow through the fluid return port to be greater than a fluid outflow through the fluid return port.

In some examples, the operations of the pump 484 and the pump 485 may be linked by a predetermined ratio r defined by:

$$r = \frac{\text{volume_pumped_by_return_pump}}{\text{volume_pumped_by_feed_pump}}$$

The volume pumped by the return pump and/or the feed (supply) pump corresponds to a pumping capacity of the pump.

In some examples, the ratio r may be such that:

$$2 \leq r \leq 10$$

In some examples, the controlling of the fluid flow may comprise cranking the engine whilst not firing the engine, to cause operation of a first pump (and/or vacuum system) to cause the fluid flow through the fluid return port into the replaceable fluid container, the cranking of the engine causing operation of a second pump (and/or vacuum system) to cause the fluid outflow through the return port out of the replaceable fluid container.

In some examples, the first pump may comprise the return pump 484 and the second pump may comprise the supply pump 485. In such examples, the fluid may be evacuated from the fluid circulation system, because the return pump 484 has a greater pumping capacity than the supply pump 485 (because of the ratio r). In such examples, as a result of the ratio r, the fluid may be pumped into the fluid container by the return (scavenge) pump 484, and any amount of fluid supplied to the fluid circulation system, because of the supply pump 485 operating, is smaller than the amount of fluid pumped into the container by the larger return (scavenge) pump 484. It should be understood that the amount of fluid supplied to the fluid circulation system compared to the amount of fluid pumped into the container by the larger return (scavenge) pump 484 decreases as the values of the ratio r increase.

Alternatively or additionally, in some examples, the controlling of the fluid flow may comprise controlling operation of a flow restrictor and/or a throttle on the fluid supply port and/or the fluid supply line.

It will now be explained below an example of operation which may be common to at least some of the examples of the apparatus described above.

In normal use, when the container 2 is connected to the system 1, the container 2 contains some of the total fluid volume, and the remainder of the fluid is in the system 1, such as in the engine sump and pipework.

In operation, the apparatus may be configured to receive a signal indicating that decoupling of the replaceable fluid container 2 from the fluid circulation system 1 is requested, for example for an intended decoupling of the replaceable fluid container 2 from the fluid circulation system 1. In some examples, the signal may further be associated with a fluid change. In some examples, a user and/or an operator may indicate to the apparatus that a decoupling, for example for an oil change, is intended. The user may use a functionality provided on the vehicle 100, using a User Interface.

The apparatus may thus comprise, at least partly, the engine control device 21, configured to receive the signal from the User Interface operated by the user and/or operator.

In some examples, in response to the received signal, the apparatus may be configured to cause, at S1, the fluid to flow into the replaceable fluid container 2 whilst inhibiting outflow of the fluid from the replaceable fluid container 2. In some examples, S1 may comprise pumping fluid into the container using at least the pump 484 and/or 485 configured to be powered and/or driven by the engine and/or an electrical power source (which may involve cranking the engine whilst not firing the engine), whilst the fluid supply from the container is disabled.

In some examples, as already mentioned, the pump 484 may comprise a scavenge pump which may be configured to evacuate oil and/or lubricant from the sump 405 and scavenge line 114. It is understood that in some examples, the scavenge line 114 may be configured to remain operated during cranking.

Cranking the engine whilst not firing the engine and/or activating the electrical power source can be done by the engine using a functionality provided on the vehicle 100. The fluid is thus collected in the replaceable fluid container 2.

Below is described an example of steps which may be performed at S1, in an example where the operations of the pump 484 and the pump 485 may be linked (e.g. both pumps 484 and 485 may be mechanically coupled and driven by the engine) by a predetermined ratio r as described above. The example is described with reference to a fluid being a lubricant, but it should be understood that any type of fluid could be collected in the fluid container by performing the same steps.

In some examples, the steps may comprise cranking the engine whilst not firing the engine, to cause operation of the pump 484 to cause the fluid flow through the fluid return port into the replaceable fluid container, the cranking of the engine causing operation of the pump 485 to cause the fluid outflow through the fluid supply port out of the replaceable fluid container. In some examples, a specific mode may be selected on the vehicle (for example on a dash of the vehicle), and the cranking may be performed for at least one iteration (for example one, two or three or more iterations), for a predetermined cranking period (the predetermined cranking period may be of the order of the second, such as e.g. 5 seconds). In some examples, the cranking may be interrupted for a predetermined waiting period between each iteration (the predetermined waiting period may be of the order of the second, such as e.g. 5 seconds).

In some examples, prior to cranking the engine without firing the engine, the steps may comprise operating the engine to a predetermined mode (for example 4200 rev/min) for a predetermined duration (for example 10 seconds), prior to stopping the engine for a predetermined waiting duration (for example 30 seconds). This step of operating the engine to a predetermined mode may occur after, for example shortly after or immediately after, having operated the engine in a typical mode, such as in normal use. It should be understood that the values of the durations and periods above are examples only and other values are envisaged.

Below is described a non-limiting example of such steps.

In a first step 1, which may follow a period of normal operation of the engine, the engine speed may be raised and held to e.g. 4200 rev/min for e.g. 10 seconds, for example when a temperature associated with the fluid circulation system (e.g. an oil gallery of the vehicle) may be at e.g. 100° C.+/−5° C. Step 1 may enable a good circulation of the oil in the fluid circulation system, as a higher temperature may help circulation of fluid in the fluid circulation system.

In a step 2, the engine may be switched off.

In a step 3, a waiting duration of e.g. 30 seconds may be kept.

In a step 4, a specific mode may be selected, e.g. an "Ignition 1" mode on a rotary ignition switch located on a dash of the vehicle. Step 4 may be a first step of a combination of steps setting up a cranking situation in which the engine cranks but is inhibited from firing, e.g. by disabling the injectors and ignition system of the vehicle.

In a step 5, an "Engine Start" button may be pressed and held down for e.g. five seconds. In some examples, the period the button is pressed and held down does not last for more than 5 seconds, to avoid damage to the engine.

In a step 6, a waiting period of e.g. 5 seconds may be kept.

In a step 7, the "Engine Start" button may be pressed and held down for e.g. five seconds.

In a step 8, a waiting period of e.g. 5 seconds may be kept.

In a step 9, the "Engine Start" button may be pressed and held down for e.g. five seconds.

The periods in steps 5 to 9 may prevent cranking of the engine for too long (which may cause damage to the engine) yet may ensure good return of oil to the container.

Once steps 1 to 9 have been performed, the fluid container may be removed from the vehicle.

In some examples, the method may further comprise receiving a level signal associated with the fluid being collected in the replaceable fluid container. This may enable to ensure that a predetermined amount of fluid has been collected in the container 2 before the container is disengaged from the fluid system 1. The signal may be provided by a fluid sensor 93 (FIGS. 2A and 2B).

In some examples, the fluid level in the container and/or the fluid level and/or pressure in the system 1 may be used to determine when to end S1. Alternatively and/or additionally, S1 may be stopped after a predetermined amount of time (depending on the power of the pump 484 for example). The predetermined amount of time may be for example of the order of a second (such as for example from a few seconds to about 25 s). Other values are envisaged.

At the end of S1, the container 2 contains the fluid, and the remainder of the total fluid volume contained in the fluid circulation system (such as a sump and/or a pipework) may be below a predetermined amount. For a fluid change (such as an oil change), the fluid initially in the fluid circulation system (or a vast majority of it) may be removed from the fluid circulation system 1, at the end of S1.

The method may further comprise removing the replaceable container 2, for example after S1 is stopped. In some examples, the replaceable fluid container may be removed from the fluid circulation system in response to the received level signal.

A new/refilled container may be coupled to the system 1. The fluid initially in the fluid circulation system has been substantially removed from the fluid circulation system 1 and does not contaminate the fresh fluid or contamination of the fresh fluid is reduced. It can also be ensured that the amount of fluid remaining in the fluid circulation system may be below a predetermined amount. It can also be ensured that a constant volume of fluid is provided to the system after the fluid change (e.g. a volume determined by the volume of the reservoir 9 of the container 2).

The fluid change is easy and inexpensive. The filter is changed at the same time as the fluid and can be done easily by the user and/or the operator.

In some examples, in operation, the apparatus (e.g. the example of the apparatus as described in reference to FIG. 4) may be configured to receive a signal associated with a stop of an operation of the engine 50 associated with the fluid circulation system 1, for example when the user stops (e.g. turns off) the engine 50 by turning the key in the vehicle 100.

The apparatus may thus comprise, at least partly, the engine control device 21 configured to receive the signal from the user and/or operator (via the key).

In some examples, in response to the received signal, the apparatus may be configured to cause, at S1, the fluid to flow into the replaceable fluid container 2 whilst inhibiting outflow of the fluid from the replaceable fluid container 2, as described above.

At the end of S1, the fluid initially in the fluid circulation system (or a vast majority of it) may be removed from the fluid circulation system 1, and substantially all of the fluid or a substantial part of the fluid is collected in the replaceable fluid container 2 (in this example of operation the container is not removed from the system 1). This may enable protection of the engine and/or the fluid during the period of non-operation of the engine, for example against external thermal variations.

Below are described non-limiting examples of self-sealing couplings, in reference to FIG. 8.

Figure 8:
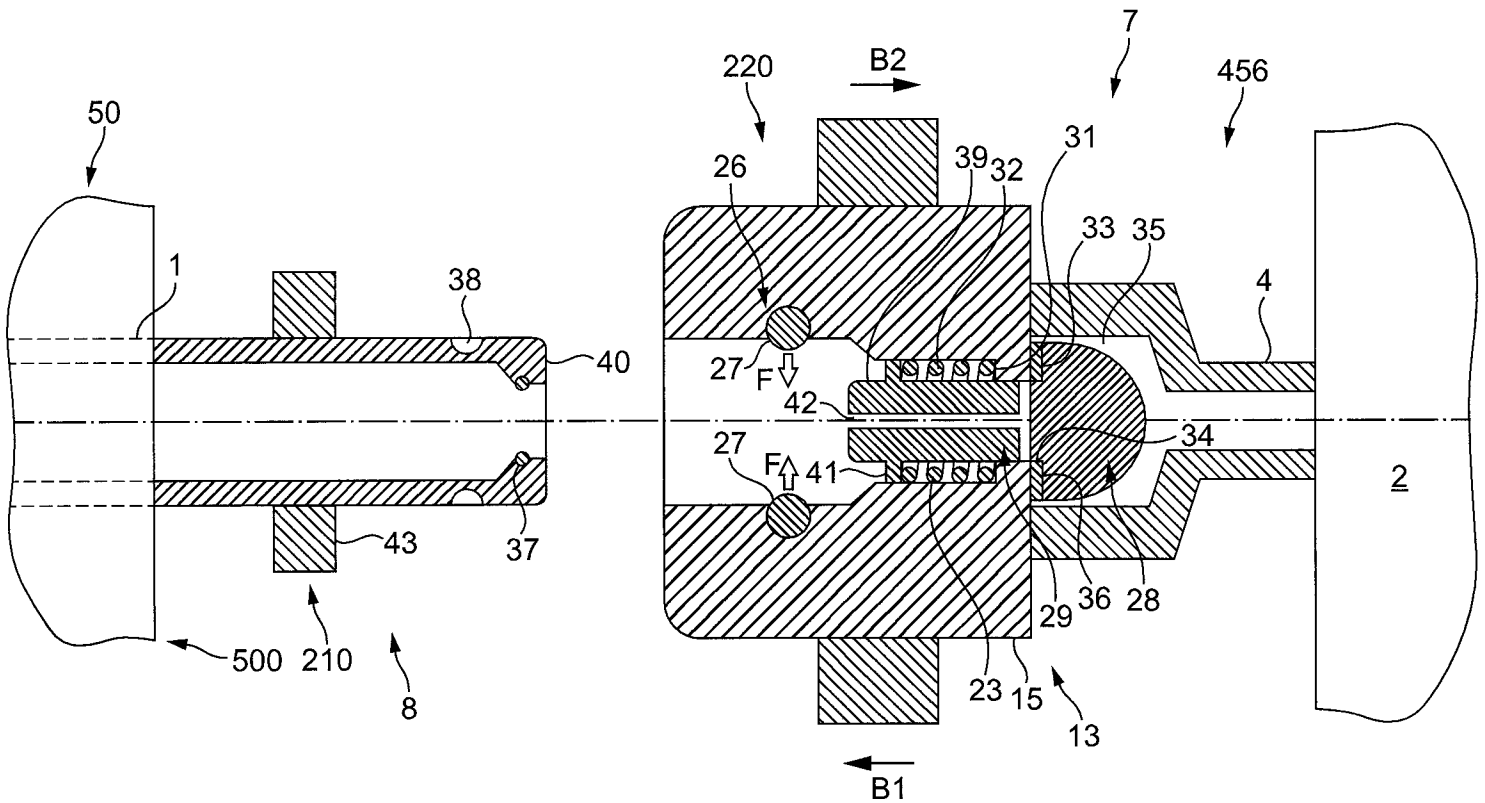
FIG. 8 represents in schematic cross-section, an example self-sealing coupling comprising a latch.

In the example of FIG. 8, the coupling 7 comprises a latch 13 suitable for use in a dock 500 and/or a container 2 of the present disclosure.

The coupling 7 and/or 8 comprises a male element 210 and a female element 220.

In some examples, the coupling 7 may comprise a self-sealing valve 28 which is biased to a closed position when the male and female elements 210 and 220 are disconnected, as shown in FIG. 8. The valve 28 comprises an axially moveable element 29 which is biased to a closed position by the action of a spring 23 acting against a face 31 on the port 4 and a face 32 on the axially moveable element 29. When in the closed position, a valve face 33 of the axially moveable element 29 bears against a valve seat 34 of the port 4 to seal a passage 35 to prevent or at least inhibit fluid flow through the valve 28. One or either or both of the valve face and valve seat may comprise a seal 36.

The male element 210 may form part of the fluid circulation system 1 associated with the engine 50 and comprises a sealing element 37, for example an O-ring. The male element 210 comprises an indent 38 which may be in the form of an external groove for receiving the balls 27 when engaged with the female member 220.

As the male element 210 is inserted into the female element, the sealing element 37 engages a circumferential face 39 of the axially moveable valve element 29. This sealably engages the male and female elements 210 and 220 before the valve allows any fluid to flow.

As the male element 210 is inserted further into the female element 220, an end 40 of the male element 210 engages a flange 41 (suitably circumferential) on the axially moveable valve element 29 and further insertion of the male element 210 causes the male element acting through the male element end 40 and the flange 41 to displace the axially moveable valve element 29 against the action of the biasing spring 23 and displace the valve face 33 from the valve seat 34 allowing fluid to flow through the passage 35 and through a duct 42 in the axially moveable valve element 29.

Thus, the self-sealing valve has the characteristic that when the coupling is being connected, a seal is made between the connecting ports before any valves open to allow fluid to flow.

As the male element 210 is inserted in the direction B1 still further into the female element 220, the male member acts upon the balls 27 in the opposite direction to F until it is sufficiently positioned inside the female element 220 for the balls 27 to engage the indent 38. This latches the male and female members 210 and 220 together and retains the container 2 in fluidic communication with the circulation system 1 associated with the engine 50. Positioning of the male and female members may be assisted by a flange 43 on the male member 210.

To disconnect the male and female members 210 and 220, the collar 15 of the latch 13 is displaced away from the male member 210. The axial movement of the collar 15 causes the balls 27 to move out of the indent 38 of the male member 210 and thereby unlatch the male member 210.

Thus, displacement of the female element 220 in the direction B2 disengages the balls 27 from the recess 38. Further displacement of the female element 220 in the direction B2 allows the axially moveable valve member 29 under the action of the spring 23 to be displaced and urge the valve face 33 against the face seat 34 thereby preventing or at least inhibiting flow of fluid through the passage 35 and duct 42. This seals the valve 28 before the male and female elements 210 and 220 are disconnected and, in particular, before the seal 37 of the male member 210 disengages the circumferential surface 39 of the axially moveable valve member 29.

After the disconnected container 2 has been removed from the engine 50 or vehicle 100, another container 2 which may contain fresh, refreshed or unused fluid 3 may be reconnected to the couplings 8. In use, the container 2 is retained in fluidic communication with the fluid circulation system 1 by the self-sealing couplings 8.

As already mentioned and as shown in FIGS. 2A and 2B, the container 2 may comprise a data provider 20, and in some non-limiting examples, the data provider 20 may be configured to provide data about the fluid container 2. In examples the data provider 20 may be coupleable to provide the data to the control device 21, such as an engine control device, via a communication link 97. The data provider 20 may be positioned on the container 2 so that, when the container 2 is coupled in fluidic communication with the circulation system 1 associated with the engine 50, the data provider 20 is also arranged to communicate the data with the control device 21, and if the container 2 is not positioned for fluidic communication with the circulation system 1, communication with the data provider 20 is inhibited.

In some examples, the data, for example data obtained from the control device 21, may further be provided to a memory. In some examples, the memory may be distributed in memories selected from a list comprising: a memory 94 of a management device (for example comprising the control device 21), a memory 104 of the data provider 20 of the container 2, and/or a memory of the dock 500 for the container 2.

The control device 21, which may be for example the engine control device, comprises a processor 96, and the memory 94 configured to store data.

In examples, the processor 96 may be configured to monitor and/or to control the operation of the engine, via communication links.

The control device 21 may be configured to obtain a signal indicating that the container 2 is coupled to the circulation system 1 associated with the engine 50 and/or to obtain data from the data provider 20 via the communication link 97.

The data provider 20 of the container 2 may comprise a processor 103 arranged to receive signals from the fluid sensor 93 and/or a latch sensor 30. The processor 103 may be arranged to communicate a signal indicating that the container 2 is coupled to the dock 500, and thus to the circulation system 1, and/or to communicate the data to the control device 21 via the communication link 97. The data provider 20 may further comprise a memory 104 for storing data describing the fluid 3. For example, the memory 104 may store data including at least one of: the grade of the fluid, the type of fluid, the date on which the container was filled or refilled, a unique identifier of the container 2, an indication of whether the container 2 is new, or has previously been refilled or replaced, an indication of the vehicle mileage, the number of times the container 2 has been refilled or reused, and the total mileage for which the container has been used.

The engine 50 may comprise an engine communication interface 106 arranged to communicate operational parameters of the engine 50, such as engine speed and throttle position, to the processor 96 of the control device 21 via a communication link 98. The engine communication interface 106 may further be operable to receive engine command from the control device 21 and to modify operation of the engine 50 based on the received commands.

The memory 94 of the control device 21 comprises non-volatile memory configured to store any one or a plurality of the following:

identifiers of acceptable fluids for use in the engine 50;

data defining a first container fluid level threshold and a second fluid level threshold;

data indicative of an expected container fluid level based on the mileage of the vehicle;

data defining a service interval, wherein the service interval is the time period between performing maintenance operations for the vehicle such as replacing the fluid;

the vehicle mileage;

sets of engine configuration data for configuring the engine to operate in a selected way;

an association (such as a look up table) associating fluid identifiers with the sets of engine configuration data; and data indicative of an expected fluid quality based on the mileage of the vehicle.

The processor 96 is operable to compare data stored in the memory 94 with data obtained from the data provider 21 of the container 2 and/or from the communication interface 106 of the engine 50.

The processor 103 of the container 2 may be configured to obtain data indicating the expected fluid level based on the mileage since the fluid was last refilled, and to compare the fluid level sensed by the sensor 93 with stored data. In the event that this comparison indicates that the fluid level is changing more quickly than expected, the data provider 20 can be configured to send data to the control device 21 to modify a service interval for the vehicle based on this comparison.

Many different types and grades of fluids 3 are available and the data provider 20 may comprise an identifier of the fluid 3.

The data provider 20 may comprise a computer readable identifier for identifying the fluid 3. The identifier may be an electronic identifier, such as a near field RF (RadioFrequency) communicator, for example a passive or active RFID (RadioFrequency Identification) tag, or an NFC (Near Field Communication) communicator.

The data provider 20 may be configured for one and/or two way communication. For example the data provider 20 may be configured only to receive data from the control device 21, so that the data can be provided to the memory 104 at the container 2. For example the memory 104 may be configured to receive data from the engine control device 21. This enables data to be stored at the container 2. Such stored data can then be provided from the memory 104 to diagnostic devices during servicing and/or during replacement of the container 2. Alternatively the data provider 20 may be configured only to provide data to the control device 21. In some possibilities, the data provider 20 is adapted to provide data to and receive data from the control device 21.

Figure 9B:
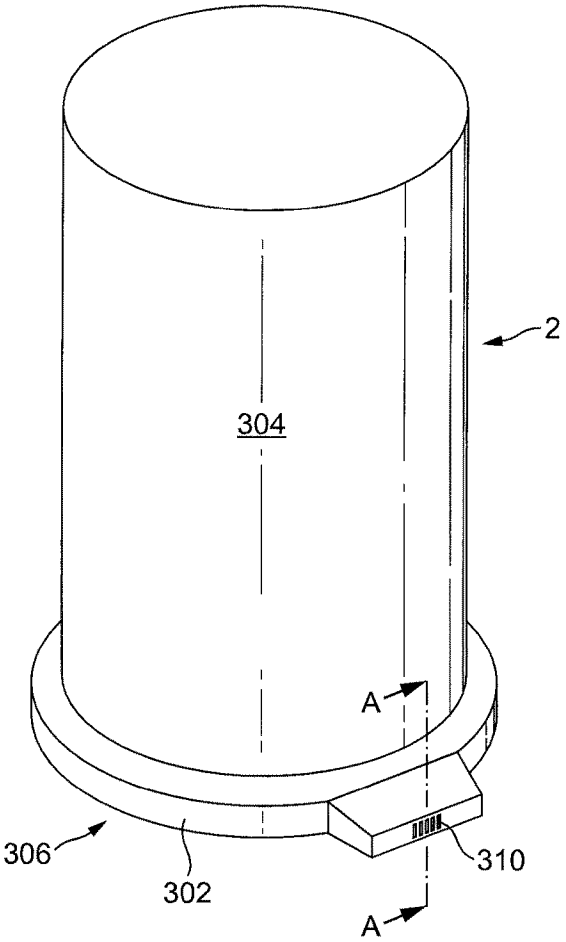
FIGS. 9A and 9B show, in schematic elevation view, a replaceable fluid container for an engine and a partial section through a wall of the container.
Figure 9A:
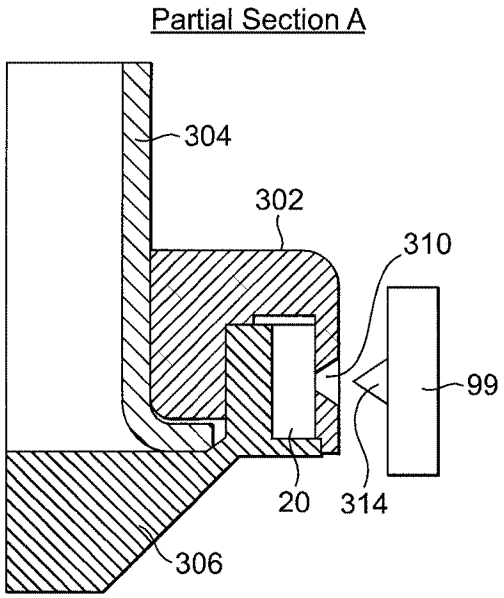

FIG. 9B shows an elevation view of a container 2 and FIG. 9A a partial section through a wall of the container 2. The container 2 comprises a body 304, and a base 306. The body 304 is secured to the base by a lip 302. The data provider 20 may be carried in the lip 302.

The lip 302 may include a data coupling 310 to enable the data provider 20 to be coupled to the interface 99 for communicating data with the control device (not shown in FIGS. 9A and 9B). The interface 99 may comprise connectors 314 for connecting the interface 99 with the data provider 20 of the container 2.

The base 306 of the container 2 comprises a fluid coupling (not shown in FIGS. 9A and 9B) for coupling fluid from the reservoir 9 of the container 2 with the circulation system 1 associated with the engine 50. The fluid coupling and the data coupling 310 are arranged so that connecting the fluid coupling in fluidic communication with the circulation system 1 associated with the engine 50 also couples the data provider 20 for data communication with the control device 21 via the interface 99 by seating the connectors 314 of the interface 99 in the data coupling 310 on the container 2.

In some examples, the interface 99 and the connectors 314 may provide electrical connections for up to e.g. eight (8) channels which provide measurements for fluid temperature, fluid pressure, fluid quality, fluid type, and the level (e.g. amount) of fluid in the container 2. The connectors 314 may be arranged to provide electrical power to the data provider 20.

At least one of the ports 4, 5 or 6 may comprise a non-return valve. Suitably, the at least one outlet port 5 comprises a non-return valve. If the container comprises more than one outlet port, suitably each outlet port comprises a non-return valve. The non-return valve in the outlet may prevent or at least inhibit fluid from draining back to the container 2 when the engine 50 is not operating and may help keep a fluid line to a circulating pump full of fluid so that circulation of fluid is immediate when operation of the engine is started.

The fluid inlet port or ports 4 may each comprise a control valve or shut-off valve which may be closed when the vehicle engine is not operating, for example to prevent or reduce fluid draining from the container 2 to the engine 50.

The vent port 6 may not contain any valves because fluid, for example gas (such as air and/or vapour), may be required to flow both to and from the container through the vent port 6 when the container is connected to the fluid circulation system 1.

As mentioned, the container 2 may comprise a filter 90 for filtering the fluid 3. This is suitable, for example when the fluid is an engine lubricating oil. Suitable filters 90 may comprise paper and/or metal filter elements. The filter 90 may be suitable for filtering particles in the range 1 to 100 microns, suitably in the range 2 to 50 microns, for example in the range 3 to 20 microns. The filter 90 may comprise a filter by-pass for fluid to bypass the filter, for example if the filter 90 becomes blocked or unacceptably loaded with material, which may cause an unacceptable fluid back-pressure through the filter 90. An advantage of having a filter 90 in the container 2 is that this may allow a larger filter to be used than if the filter were in a separate container associated with the fluid circulation system 1. This may have one or more of the following benefits: (a) increased filtration efficiency; (b) finer filtration and (c) increased filter lifetime. Suitably, in use, fluid enters the container 2 through the inlet port 4 and is passed to the top of the container 2, for example through at least one conduit in the container 2; some or all of the fluid 3 is passed through the filter 90 on exiting said conduit; and the totally or partially filtered fluid is withdrawn from the base of the container through the outlet port 5. The filter 90 may operate at elevated pressure.

The container 2 may be manufactured from metal and/or plastics material. Suitable materials include reinforced thermoplastics material which for example, may be suitable for operation at temperatures of up to 150° C. for extended periods of time.

The container 2 may comprise at least one trade mark, logo, product information, advertising information, other distinguishing feature or combination thereof. The container 2 may be printed and/or labelled with at least one trade mark, logo, product information, advertising information, other distinguishing feature or combination thereof. This may have an advantage of deterring counterfeiting. The container 2 may be of a single colour or multi-coloured. The trademark, logo or other distinguishing feature may be of the same colour and/or material as the rest of the container or a different colour and/or material as the rest of the container. In some examples, the container 2 may be provided with packaging, such as a box or a pallet. In some examples, the packaging may be provided for a plurality of containers, and in some examples a box and/or a pallet may be provided for a plurality of containers.

The container 2 may be a container 2 for a fluid which is a liquid. As already mentioned, suitable liquids include engine lubricating oil and/or heat exchange and/or charge conduction and/or electrical connectivity fluid for an electric engine.

The container 2 may be a container for an engine lubricating oil. Thus, the container may contain engine lubricating oil. In this embodiment, the container 2 may be provided as a self-contained container containing fresh, refreshed or unused lubricating oil which may easily replace a container (for example on the engine 50) which is empty or contains used or spent lubricating oil. If the container 2 also comprises the filter 90, this also is replaced together with the spent or used lubricating oil. Thus, a fluid reservoir container 2 containing spent or used lubricating oil retained in fluidic communication with the fluid circulation system 1 may be disconnected from the fluid circulation system, removed from the vehicle and replaced by a container containing fresh, refreshed or unused lubricating oil and if present a fresh, renewed or new filter.

In some examples, a part of the container 2 (for example the part 10 comprising the ports and/or the filter) may be separated from the part 11, and a new part 10 may be attached to the part 11. The part 11 may thus be re-used.

The container may be at least partly recyclable and/or re-useable. In some examples, the part 10 and/or part 11 of the container may be recycled and/or re-used.

The engine lubricating oil may comprise at least one base stock and at least one engine lubricating oil additive. Suitable base stocks include bio-derived base stocks, mineral oil derived base stocks, synthetic base stocks and semi synthetic base stocks. Suitable engine lubricating oil additives are known in the art. The additives may be organic and/or inorganic compounds. Typically, the engine lubricating oil may comprise about 60 to 90% by weight in total of base stocks and about 40 to 10% by weight additives. The engine lubricating oil may be a lubricating oil for an internal combustion engine. The engine lubricating oil may be a mono-viscosity grade or a multi-viscosity grade engine lubricating oil. The engine lubricating oil may be a single purpose lubricating oil or a multi-purpose lubricating oil.

The engine lubricating oil may be a lubricating oil for an internal combustion engine. The engine lubricating oil may be a lubricating oil for a spark ignition internal combustion engine. The engine lubricating oil composition may be a lubricating oil for a compression internal combustion engine.

The container may be a container for heat exchange fluid for an electric engine. Thus, the container may contain heat exchange fluid for an electric engine. In such as case, the container may be provided as a self-contained container containing fresh, refreshed or unused heat exchange fluid for an electric engine which may easily replace a container (for example on the engine) which can be empty or can contain used or spent heat exchange fluid. If the container also comprises a filter, this also is replaced together with the spent or used heat exchange fluid.

Electric engines may require heat exchange fluid to heat the engine and/or cool the engine. This may depend upon the operating cycle of the engine. Electric engines may also require a reservoir of heat exchange fluid. The fluid reservoir container may provide a heat storage container in which heat exchange fluid may be stored for use to heat the electric engine when required. The fluid reservoir container may provide a container for storage of coolant at a temperature below the operating temperature of the engine for use to cool the electric engine when required.

Suitable heat exchange fluids for electric engines, which may have additional functionality (such as the primary function) which may include for example charge conduction and/or electrical connectivity, may be aqueous or non-aqueous fluids. Suitable heat exchange fluids for electric engines may comprise organic and/or non-organic performance boosting additives. Suitable heat exchange fluids may be man-made or bio-derived, for example Betaine. The heat exchange fluids may have fire retarding characteristics and/or hydraulic characteristics. Suitable heat exchange fluids include phase change fluids. Suitable heat exchange fluids include molten metals or salts. Suitable heat exchange fluids include nanofluids. Nanofluids comprise nanoparticles suspended in a base fluid, which may be solid, liquid or gas. Suitable heat exchange fluids include gases and liquids. Suitable heat exchange fluids include liquefied gases.

The engine 50 may be any type of engine for example for a vehicle and/or may also be a reverse engine, such as a generator, such as a wind turbine generator.

The container may be suitable for operating at temperatures of from ambient temperature up to 200° C., suitably from −20° C. to 180° C., for example from −10° C. to 150° C.

The container may be suitable for operating at gauge pressures up to 15 bar (unit of gauge pressure, 1 Pa=10-5 bar), suitably from −0.5 bar to 10 bar, for example from 0 bar to 8 bar.

Suitable vehicles include motorcycles, earthmoving vehicles, mining vehicles, heavy duty vehicles and passenger cars. Powered water-borne vessels are also envisaged as vehicles, including yachts, motor boats (for example with an outboard motor), pleasure craft, jet-skis and fishing vessels. Also envisaged, therefore, are vehicles comprising a system of the present disclosure, or having been subject to a method of the present disclosure, in addition to methods of transportation comprising the step of driving such a vehicle and uses of such a vehicle for transportation.

The fluid reservoir container is advantageous where rapid replacement of the fluid is required or advantageous, for example in "off-road" and/or "in field" services.

Although the example shown in FIGS. 9A and 9B comprises conductive electrical connections 314 for communicating with the data provider 20, a contactless connection may also be used. For example, inductive or capacitive coupling can be used to provide contactless communication. One example of inductive coupling is provided by RFID, however other near field communications technology may also be used. Such couplings may enable electrical power to be transferred to the data provider 20, and also have the advantage that the data connection does not require any complex mechanical arrangement and the presence of dirt or grease on the couplings 310, 314 is less likely to inhibit communication with the data provider 20.

The container 2 may comprise a power provider such as a battery for providing electrical power to the data provider 20. This may enable the container 2 to be provided with a range of sensors, including sensors for fluid temperature, pressure and electrical conductivity. Where the container 2 comprises a filter, sensors may be arranged to sense these parameters of the fluid as the fluid flows into the filter, and after the fluid has flowed through the filter.

The function of the processors 103, 96 may be provided by any appropriate controller, for example by analogue and/or digital logic, field programmable gate arrays, FPGA, application specific integrated circuits, ASIC, a digital signal processor, DSP, or by software loaded into a programmable general purpose processor.

Aspects of the disclosure provide computer program products, and tangible non-transitory media storing instructions to program a processor to perform any one or more of the methods described herein.

The memory 104 is optional. The computer readable identifier may be an optical identifier, such as a barcode, for example a two-dimensional barcode, or a colour coded marker, or optical identifier on the container 2. The computer readable identifier may be provided by a shape or configuration of the container 2. Regardless of how it is provided, the identifier may be encrypted.

The communication links 97 and/or 98 may be any wired or wireless communication link, and may comprise an optical link.

It should be understood that the above examples of the apparatus can be combined.

Although circulated fluid is described as being returned to the fluid container 2 for recirculation, in the context of the present disclosure, those skilled in the art will appreciate that circulated fluid could be expelled (as is the case for de-icer) and/or collected and/or stored in a container coupled to the engine 50 and, when convenient, emptied from or otherwise removed, e.g., from the vehicle 100.

Other variations and modifications of the apparatus will be apparent to persons of skill in the art in the context of the present disclosure.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope and spirit of this invention.

The invention claimed is:

1. A method for controlling fluid distribution in a fluid circulation system associated with an engine, the fluid circulation system being coupled to a replaceable fluid container comprising:

a fluid supply port configured to couple to a fluid supply line of the fluid circulation system, a fluid return port configured to couple to a fluid return line of the fluid circulation system, and a breather port configured to couple to a breather output of the fluid circulation system;

the method comprising:

causing the fluid to flow into the replaceable fluid container from the fluid circulation system whilst inhibiting outflow of the fluid from the replaceable fluid container into the fluid circulation system, so as to collect the fluid in the replaceable fluid container, and causing a gas to flow from the replaceable fluid container through the breather port whilst inhibiting outflow of the fluid from the replaceable fluid container into the fluid circulation system.

2. The method of claim 1, wherein inhibiting fluid outflow from the replaceable fluid container comprises:

inhibiting fluid flow through the fluid supply port, comprising:

blocking the fluid supply port and/or blocking the fluid supply line; and/or disabling a pump and/or a vacuum system causing the outflow through the fluid supply port and/or the fluid supply line; and/or controlling a fluid flow in the fluid circulation system to cause a fluid flow through the fluid return port to be greater than a fluid outflow through the fluid return port.

3. The method of claim 1 or 2, further comprising:

connecting the fluid supply line to a vent whilst inhibiting outflow of the fluid from the replaceable fluid container into the fluid circulation system.

4. The method of claim 3, wherein the vent is provided on the fluid circulation system.

5. The method of claim 1, further comprising:

maintaining open the breather port of the container.

6. The method of claim 1, further comprising:

connecting the fluid supply line to the breather port and/or breather output.

7. The method of claim 1, wherein inhibiting the outflow comprises:

inserting an insert interface between the container and the fluid circulation system, the insert interface being configured to:

block the fluid supply port, and maintain open the fluid return port.

8. The method of claim 7 wherein the insert interface is further configured to:

maintain open the breather port of the container.

9. The method of claim 7, wherein the insert interface is further configured to:

connect the fluid supply line to a vent.

10. The method of claim 7, wherein the insert interface is further configured to:

connect the fluid supply line to the breather port and/or breather output.

11. The method of claim 7, wherein the fluid circulation system comprises a dock configured to receive the replaceable fluid container, and wherein inserting the insert interface further comprises:

inserting the insert interface in the dock.

12. The method of claim 1, wherein inhibiting the outflow comprises:

closing a valve configured to block the fluid supply line and/or the fluid supply port.

13. The method of claim 12, wherein the valve is configured to be actuated by a user and/or an actuator controlled by a controller.

14. The method of claim 12, wherein the valve is located on the fluid supply line.

15. The method of claim 12, wherein the valve is further configured to:

maintain open a connection between the fluid supply line and a vent.

16. The method of claim 1, wherein inhibiting the outflow comprises:

coupling the fluid container with respect to the fluid circulation system or a dock configured to receive the replaceable fluid container, in a blocking spatial configuration different from a normal use spatial configuration, and wherein, in the blocking spatial configuration, the fluid supply port is spatially separated from the fluid supply line.

17. The method of claim 16, wherein coupling the fluid container with respect to the fluid circulation system or the dock in the blocking spatial configuration comprises changing the spatial orientation of the fluid container with respect to the fluid circulation system or the dock.

18. The method of claim 16, wherein, in the normal use spatial configuration:

the fluid supply port is coupled to the fluid supply line and the fluid return port is coupled to the fluid return line; and wherein, in the blocking spatial configuration:

the fluid supply port is coupled to the fluid return line of the fluid circulation system and the fluid return port is blocked.

19. The method of claim 18, wherein in the normal use spatial configuration:

the breather port is coupled to the breather output; and wherein, in the blocking spatial configuration:

the breather port is coupled to the fluid supply line of the fluid circulation system.

20. The method of claim 19, wherein, in the blocking spatial configuration:

the breather output of the fluid circulation system is blocked.

21. The method of claim 1, wherein inhibiting the outflow comprises:

coupling the fluid container with respect to the fluid circulation system in a blocking configuration, different from a normal use configuration, and wherein, in the blocking configuration, coupling between the fluid supply port and the fluid supply line is not made.

22. The method of claim 21, wherein at least one of the fluid supply port or the fluid supply line comprises:

a coupling configured to be operated between a normal use configuration and a blocking configuration, and wherein, in the blocking configuration of the coupling, coupling between the fluid supply port and the fluid supply line is not made.

23. The method of claim 22, wherein the coupling comprises a cam configured to cooperate with a cam-engaging surface and/or a recess.

24. The method of claim 1, further comprising:

receiving a signal indicating that a decoupling of the replaceable fluid container from the fluid circulation system is required, and in response to the received signal, causing the fluid to flow into the replaceable fluid container whilst inhibiting outflow of the fluid from the replaceable fluid container.

25. The method of claim 24, wherein the signal is further associated with a fluid change.

26. The method of claim 1, further comprising:

receiving a signal associated with a stop of an operation of the engine associated with the fluid circulation system, and in response to the received signal, causing the fluid to flow into the replaceable fluid container whilst inhibiting outflow of the fluid from the replaceable fluid container.

27. The method of claim 1, wherein causing the fluid to flow into the replaceable fluid container comprises:

pumping the fluid into the container using at least a pump and/or drawing the fluid into the container using a vacuum system.

28. The method of claim 27, wherein the pump and/or the vacuum system is configured to be powered and/or driven by the engine and/or an electrical power source.

29. The method of claim 28, wherein the pump and/or the vacuum system is powered and/or driven by a crankshaft of the engine.

30. The method of claim 28, wherein the electrical power source is associated with the engine.

31. The method of claim 28, wherein the electrical power source is external to a vehicle associated with the engine.

32. The method of claim 28, further comprising:

cranking the engine or activating the electrical power source whilst not firing the engine.

33. The method of claim 1, further comprising measuring a fluid pressure in the fluid circulation system.

34. The method of claim 1, further comprising:

receiving a level signal associated with the fluid being collected in the replaceable fluid container; and in response to the received level signal, removing the replaceable fluid container from the fluid circulation system.

35. The method of claim 1, wherein inhibiting fluid outflow from the replaceable fluid container comprises:

controlling a fluid flow in the fluid circulation system to cause a fluid flow through the fluid return port to be greater than a fluid outflow through the fluid return port, comprising:

cranking the engine whilst not firing the engine, to cause operation of a first pump and/or vacuum system to cause the fluid flow through the fluid return port into the replaceable fluid container, the cranking of the engine causing operation of a second pump and/or vacuum system to cause the fluid outflow through the return port out of the replaceable fluid container;

wherein a ratio r of a volume of fluid caused to flow into the replaceable fluid container by the first pump and/or vacuum system on a volume caused to flow out of the replaceable fluid container by the second pump and/or vacuum system is such that:

$2 \leq r \leq 10$.

36. The method of claim 35, further comprising, prior to controlling the fluid flow in the fluid circulation system:

operating the engine to a predetermined mode for a predetermined duration, prior to stopping the engine for a predetermined waiting duration.

37. The method of claim 35, wherein cranking the engine whilst not firing the engine comprises:

select a specific mode on the vehicle; and cranking the engine whilst not firing the engine for at least one iteration, for a predetermined cranking period.

38. The method of claim 37, further comprising:

interrupting the cranking for a predetermined waiting period between each iteration.

39. The method of claim 38, wherein the predetermined cranking period and/or the predetermined waiting period is of the order of the second.

40. An apparatus configured to control fluid distribution in a fluid circulation system associated with an engine, the fluid circulation system being coupled to a replaceable fluid container comprising:

a fluid supply port configured to couple to a fluid supply line of the fluid circulation system, a fluid return port configured to couple to a fluid return line of the fluid circulation system, and a breather port configured to couple to a breather output of the fluid circulation system;

wherein the apparatus is configured to cause the fluid to flow into the replaceable fluid container from the fluid circulation system whilst inhibiting outflow of the fluid from the replaceable fluid container into the fluid circulation system, so as to collect the fluid in the replaceable fluid container, and to cause a gas to flow from the replaceable fluid container through the breather port whilst inhibiting outflow of the fluid from the replaceable fluid container into the fluid circulation system.

* * * * *